US010793334B2

(12) United States Patent
Asai et al.

(10) Patent No.: US 10,793,334 B2
(45) Date of Patent: Oct. 6, 2020

(54) PACKAGING BAG

(71) Applicant: Toyo Seikan Co., Ltd., Tokyo (JP)

(72) Inventors: Hayato Asai, Yokohama (JP); Masahiro Horikawa, Yokohama (JP); Noriyuki Kaihatsu, Yokohama (JP); Shie Matsunaga, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 15/566,241

(22) PCT Filed: Apr. 12, 2016

(86) PCT No.: PCT/JP2016/001986
§ 371 (c)(1),
(2) Date: Oct. 13, 2017

(87) PCT Pub. No.: WO2016/166968
PCT Pub. Date: Oct. 20, 2016

(65) Prior Publication Data

US 2018/0118440 A1 May 3, 2018

(30) Foreign Application Priority Data

Apr. 16, 2015 (JP) ..... 2015-083942
Dec. 11, 2015 (JP) ..... 2015-241780

(51) Int. Cl.
*B65D 77/00* (2006.01)
*B65D 77/30* (2006.01)
(Continued)

(52) U.S. Cl.
CPC ..... *B65D 77/30* (2013.01); *B65D 31/02* (2013.01); *B65D 75/5805* (2013.01)

(58) Field of Classification Search
CPC ..... B65D 77/30; B65D 31/02; B65D 75/5805
(Continued)

(56) References Cited

U.S. PATENT DOCUMENTS 3,081,174 A * 3/1963 Gay ..... B65D 81/3415 383/103
3,321,126 A * 5/1967 Rivman ..... B65D 33/30 383/203
(Continued)

FOREIGN PATENT DOCUMENTS

EP 1055612 A1 11/2000
FR 2832698 A1 5/2003
(Continued)

OTHER PUBLICATIONS

Communication dated Oct. 12, 2018, from the European Patent Office in corresponding European Application No. 16779764.6.
(Continued)

*Primary Examiner* — Peter N Helvey
(74) *Attorney, Agent, or Firm* — Sughrue Mion, PLLC

(57) ABSTRACT

Provided is a packaging bag (1) in which a broken piece can be separated easily at the time of unsealing. In a packaging bag (1) in which unsealing is conducted from a sealed part (2) on an unsealing start side to a sealed part (4) on an unsealing terminal side via an accommodation part (3), an easily-openable part (10) is provided at the sealed part (2) on the unsealing start side, and an inner edge of the sealed part (4) on the unsealing terminal side is an inner edge inclined part (**5*u*) that crosses an unsealing virtual straight line (12) linearly drawn in an unsealing direction from the easily-openable part (10) to the sealed part (4) on the unsealing terminal side via the accommodation part (3), and is inclined relative to the unsealing virtual straight line (12**).

17 Claims, 32 Drawing Sheets

(51) Int. Cl.
*B65D 75/58* (2006.01)
*B65D 30/08* (2006.01)

(58) Field of Classification Search
USPC ..... 383/209
See application file for complete search history.

(56) References Cited

U.S. PATENT DOCUMENTS 3,780,781 A * 12/1973 Uramoto ..... B29C 66/4722 383/204
3,827,472 A * 8/1974 Uramoto ..... B65D 33/2533 383/107
4,171,755 A * 10/1979 Carlisle ..... B65D 75/48 222/107
4,301,925 A * 11/1981 Bogart ..... B65D 75/68 383/203
4,598,826 A * 7/1986 Shinbach ..... B65D 75/5827 229/5.82
4,903,841 A * 2/1990 Ohsima ..... B65D 75/5805 229/237
5,186,543 A * 2/1993 Cochran ..... B65D 33/2533 383/203
5,312,659 A * 5/1994 Otsuka ..... B32B 15/08 428/35.2
5,470,419 A * 11/1995 Sasaki ..... B29C 47/0021 156/244.12
5,547,284 A * 8/1996 Imer ..... B65D 75/5866 383/104
5,613,779 A * 3/1997 Niwa ..... B65D 75/5805 383/201
5,700,091 A * 12/1997 Tanaka ..... B32B 27/08 383/63
5,783,266 A * 7/1998 Gehrke ..... B32B 27/00 428/34.3
6,074,097 A * 6/2000 Hayashi ..... B23K 26/0846 383/208
6,217,216 B1 * 4/2001 Taheri ..... B29C 47/0023 383/207
6,309,104 B1 * 10/2001 Koch ..... B65D 75/58 206/484
6,360,513 B1 * 3/2002 Strand ..... B65D 33/2591 493/213
6,702,462 B2 * 3/2004 Richardson ..... B65D 75/566 222/107
6,708,826 B1 * 3/2004 Ginsberg ..... B65D 33/001 206/425
2003/0138169 A1 * 7/2003 Bell ..... B65D 75/008 383/7
2004/0131286 A1 * 7/2004 Rosen ..... B65D 75/008 383/209
2005/0031232 A1 * 2/2005 Jammet ..... B65D 33/2533 383/200
2006/0177162 A1 * 8/2006 Harano ..... B65D 75/5816 383/202
2008/0063324 A1 3/2008 Bernard et al.

FOREIGN PATENT DOCUMENTS

JP 7-69370 A 3/1995
JP 2003-137308 A 5/2003
JP 2004-238047 A 8/2004
JP 2004-276955 A 10/2004
JP 2007-39122 A 2/2007
JP 2007-276823 A 10/2007
JP 200923704 A 2/2009
JP 2014-51310 A 3/2014
JP 2014-55016 A 3/2014
WO 9011946 A1 10/1990

OTHER PUBLICATIONS

International Preliminary Report on Patentability and Translation of the Written Opinion dated Oct. 26, 2017 from the International Bureau in counterpart International application No. PCT/JP2016/001986.
International Search Report dated Jul. 12, 2016 from the International Bureau in counterpart International application No. PCT/JP2016/001986.
Communication dated Sep. 19, 2018 from the State Intellectual Property Office of the P.R.C. in counterpart application No. 201680021831.4.

* cited by examiner

PACKAGING BAG

CROSS REFERENCE TO RELATED APPLICATIONS

This application is a National Stage of International Application No. PCT/JP2016/001986, filed on Apr. 12, 2016, which claims priority from Japanese Patent Application No. 2015-083942, filed on Apr. 16, 2015, and Japanese Patent Application No. 2015-241780, filed on Dec. 11, 2015, the contents of all of which are incorporated herein by reference in their entirety.

TECHNICAL FIELD

The present invention relates to a packaging bag, more particularly, a packaging bag that can be unsealed from one side sealed part to the other side sealed part with fingers.

BACKGROUND ART

In recent years, packaging bags, such as retort pouches, containing contents are widely used. Many of such packaging bags are opened by tearing a portion close to the upper sealed part with one's fingers from one side sealed part to the other side sealed part. In order to facilitate unsealing, easily-openable parts such as notches and incisions are formed in the side sealed parts of many packaging bags. In addition, in the following Patent Document 1, disclosed is a soft packaging bag in which, in order to facilitate unsealing, a start-to-cut incision processing is performed in the peripheral heat-sealed part, and continuing to the start-to-cut incision processing, a continue-to-cut incision processing is performed on the non-heat-sealed part.

RELATED ART DOCUMENTS

Patent Documents

Patent Document 1: JP-A-2003-137308

SUMMARY OF THE INVENTION

Problems to be Solved by the Invention

When unsealing a packaging bag containing viscous contents such as retort curry, it is desirable not only to tear the packaging bag from the end to the end, but also to separate the tom broken piece from the bag. If the broken piece remains without being separated, the contents adhered to the broken piece may adhere to the hands when taking out the contents. Also, when forcibly trying to tear off the remaining broken piece, the contents adhered to the broken piece may splash around accidentally.

FIG. 27 and FIG. 28 show the manner how a conventional packaging bag is unsealed. The conventional packaging bag is a flat pouch formed by superimposing a front film 101*a* and a back film 101*b* and heat-sealing all sides with the left and right side sealed parts 102 and 104, a top sealed part 106, and a bottom sealed part 108. In the example shown in FIGS. 27 and 28, the packaging bag is unsealed from a notch 110 on the left side sealed part 102 to the right side sealed part 104. As the broken piece 100 moves to the right side, break lines 110*a* and 110*b* tearing the front film 101*a* and the back film 101*b* are formed towards the right side sealed part 104.

As shown in FIG. 28, in an accommodation part between the left and right side sealed parts 102 and 104, the break line 110*a* of the front film 101*a* and the break line 110*b* of the back film 101*b* are misaligned vertically. As a result, the break line 110*a* and the break line 110*b* often arrive at different positions on an inner edge 104*a* of the right side sealed part 104.

FIG. 29 shows an enlarged view of a part surrounded by a dashed line C in FIG. 28. On the inner edge 104*a* of the side sealed part 104, the arrival point Pa of the break line 110*a* of the front film 101*a* and the arrival point Pb of the break line 110*b* of the back film 101*b* are remote by a distance W. In order to further tear the side sealed part 104 from the arrival points Pa and Pb, it is necessary to peel off a heat-sealed part of the side sealed part 104 with a width corresponding to this distance W. However, since a large force is required to break the side sealed part 104 while peeling it off, it may often be difficult to separate the broken piece 100.

The present invention has been attained taking the above-mentioned circumstances into consideration, and is aimed at providing a packaging bag in which, when unsealing a packaging bag from a sealed part at an unsealing start side to a sealed part at an unsealing terminal side via an accommodation part, a broken piece can be separated easily while preventing adhered contents from scattering around.

Means for Solving the Problems

The inventors of the present invention made various experiments and studies. As a result, they noticed that, when a packaging bag is unsealed, if the break line of the front film and the break line of the back film finally reach the same point on the inner edge of the sealed part on the unsealing terminal side, it is not necessary to peel off the front film and the back film with a large force and it is possible to tear apart the sealed part on the unsealing terminal side with a small shearing force and to easily separate the broken piece of the packaging bag.

The packaging bag of the present invention is a packaging bag that has a sealed part at an end of a front film and a back film being superimposed on each other, and is unsealed from a sealed part on an unsealing start side to a sealed part on an unsealing terminal side across an accommodation part, an easily-openable part is provided on the sealed part on the unsealing start side, and, in the accommodation part between the sealed part on the unsealing start side and the sealed part on the unsealing terminal side, a front unsealing guide line provided on the front film and a back unsealing guide line provided on the back film are provided, the front unsealing guide line and the back unsealing guide line extend in an inclined manner with respect to an unsealing virtual straight line linearly drawn in an unsealing direction from the easily-openable part to the sealed part on the unsealing terminal side, and an end on the unsealing terminal side of the front unsealing guide line and an end on the back unsealing guide line of the back unsealing guide line are superimposed on each other on an inner edge or in the vicinity of the inner edge of the sealed part on the unsealing terminal side or on an lower edge or in the vicinity of the lower edge of the sealed part on an opening side.

In the packaging bag of the present invention, the unsealing guide lines are provided such that the end on the unsealing terminal side of the front unsealing guide line and the end on the unsealing terminal side of the back unsealing guide line are superimposed on the inner edge or in the vicinity of the inner edge on the unsealing terminal side, or on the lower edge or in the vicinity of the lower edge of the sealed part on the opening side. Therefore, when the packaging bag is unsealed, even if the break lines of the front film and the back film are displaced upward and downward, the break line of the front film and the break line of the back film that respectively reach the front unsealing guide line and the back unsealing guide line are guided by the front unsealing guide line and the back unsealing guide line so that they are joined in a superimposed manner on the inner edge or until they reach the inner edge of the sealed part on the unsealing terminal side.

As a result, the break line of the front film guided by the front unsealing guide line and the break line of the back film guided by the back unsealing guide line are joined, and finally arrive at the same point on the inner edge of the sealed part of the unsealing terminal side. As a result, the sealed part on the unsealing terminal side can be tom off with a small shear strength, whereby a broken piece of a packaging bag can be easily separated.

Advantageous Effects of the Invention

According to the packaging bag of the present invention, when unsealing the packaging bag, a broken piece can be easily separated. Furthermore, adhesion of contents to the hands from a broken piece, and scattering of contents during separation are also prevented. In addition, since it is unnecessary to use special processing such as laser processing or a special film such as a linearly-cuttable film, cost reduction can also be attained.

BEST MODE FOR CARRYING OUT THE INVENTION

Hereinbelow, an embodiment of the packaging bag according to the present invention with reference to the drawings.

First Embodiment

Figure 1A:
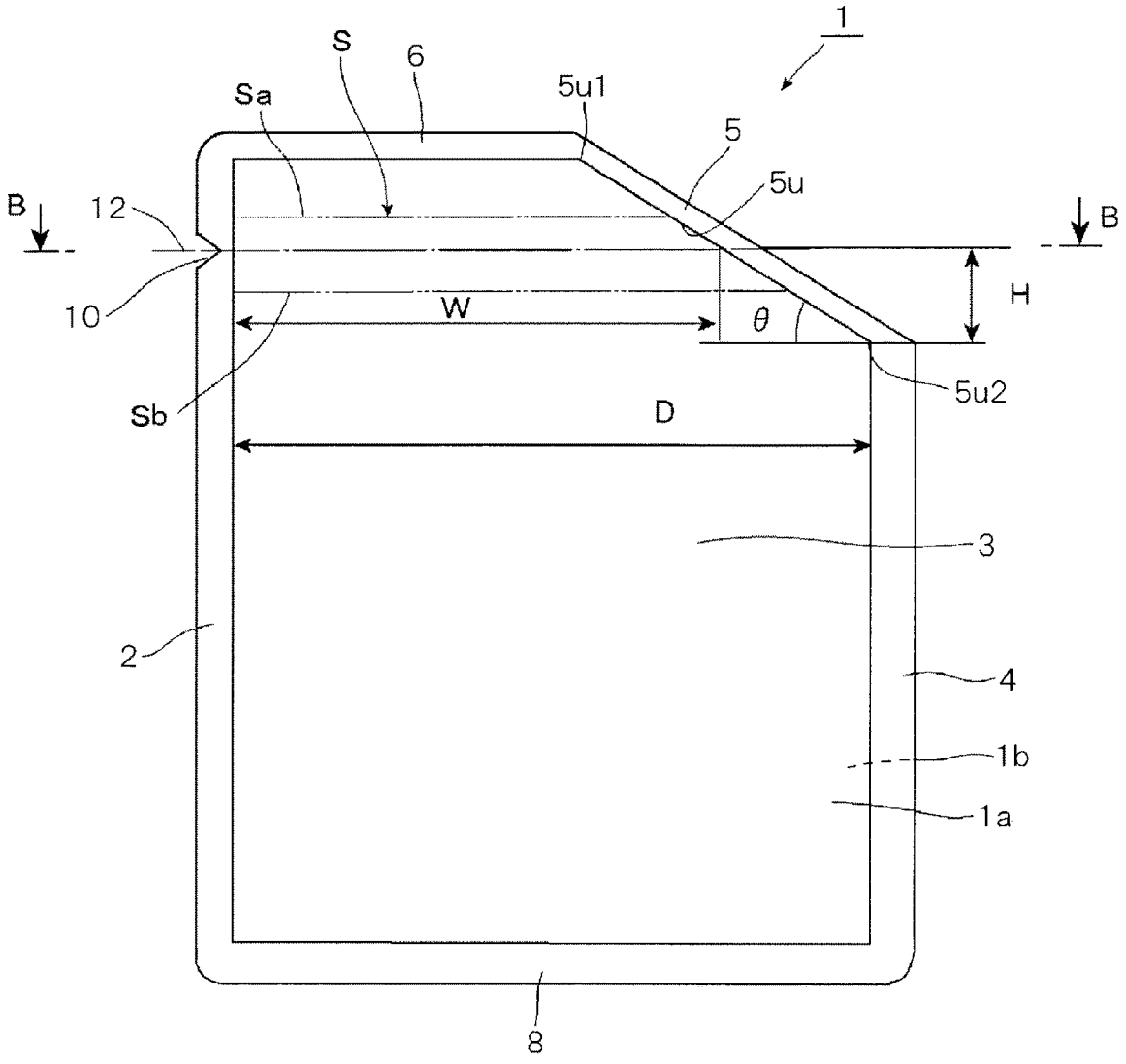
FIG. 1A shows a front view of the packaging bag according to a first embodiment of the present invention.
Figure 1B:
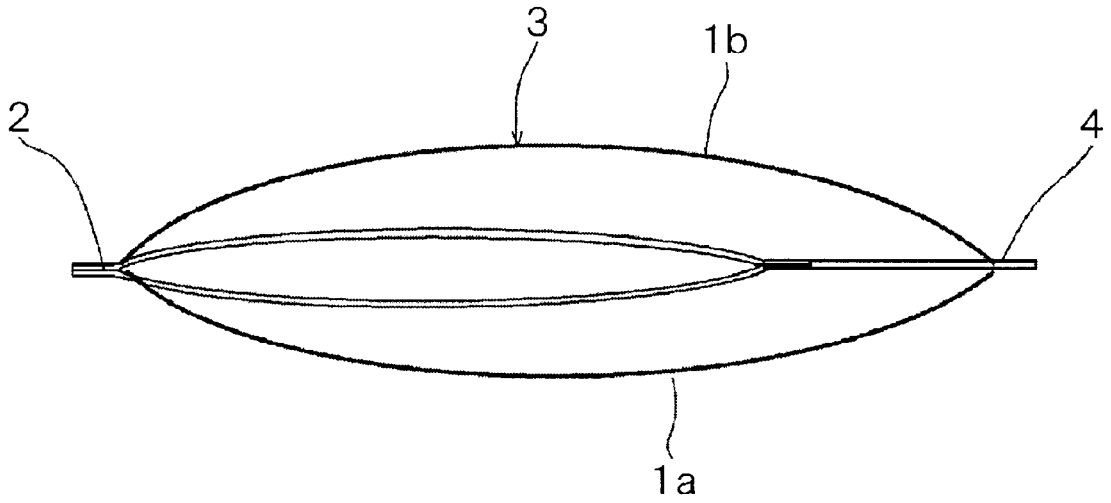
FIG. 1B shows a cross-sectional view taken along line B-B in FIG. 1A.

FIG. 1A shows a front view of the packaging bag according to the first embodiment of the present invention. A packaging bag 1 is a flat pouch formed by superimposing a front film 1*a* on a back film 1*b*. In the packaging bag 1, with the side where an open port is planned to be formed being upward, an accommodation part 3 is formed by a top sealed part 6 on the upper edge, side sealed parts 2 and 4 on the left and right lateral edges, and a bottom sealed part 8 of the lower edge (bottom). Contents to be accommodated within the accommodation part 3 are filed in the packaging bag 1 from the bottom, in which the edges other than the bottom are sealed. After filling the contents, the bottom is heat-sealed to form the bottom sealed part 8, whereby the packaging bag 1 is sealed. As shown in FIG. 1B, in the packaging bag 1 in which the contents are filled, the front film 1*a* and the back film 1*b* are inflated forward and backward. Contents may be filled in the packaging bag 1 from the upper edge or the left and right lateral edges of the packaging bag 1.

Various heat-sealable materials can be used for the front film 1*a* and the back film 1*b*. For example, each of the front film 1*a* and the back film 1*b* may be a single layer film made from heat-sealable thermoplastic resin or a laminated film having a heat-sealable surface formed of thermoplastic resin. Each of the front film 1*a* and the back film 1*b* may have a laminate structure in which a barrier layer such as an aluminum layer is disposed between laminated films.

In the packaging bag 1 shown in FIG. 1A, the side sealed part 2 is on the unsealing start side. In the side sealed part 2, an easily-openable part 10 for unsealing the upper part of the packaging bag 1 is formed. In the shown example, an easily-openable part 10 is a notch. The easily-openable part 10 is not limited to a notch. The easily-openable part 10 may be of various configurations such as one slit or a row of plural slits.

The unsealing direction of the packaging bag 1 is in parallel with the top sealed part 6 and is orthogonal to the side sealed part 4. An inclined seal part 5 is formed as the sealed part on the unsealing terminal side positioned in the unsealing direction as viewed from the easily-openable part 10 on the unsealing start side. The inclined sealed part 5 is inclined between the top sealed part 6 and upper end of other side sealed part 4. A straight line extending from the easily-openable part 10 to the inclined sealed part 5 on the unsealing terminal side across the accommodation part 3 is an unsealing virtual straight line 12.

In the present embodiment, an inner edge of the inclined sealed part 5 on the unsealing terminal side is an inner edge inclined part 5*u* that crosses the unsealing virtual straight line 12 and is inclined by a prescribed angle θ relative to the unsealing virtual straight line 12.

The inner edge inclined part 5*u* of the inclined sealed part 5 covers at least a range S in which the break lines of the front film 1*a* and the back film 1*b* are misaligned (hereinafter referred to as the "front and back misalignment range S"). FIG. 1A schematically shows the upper limit Sa and the lower limit Sb of the front and back misalignment range S by an alternate long and two short dashed line. The front and back misalignment range S is set such that it is positioned between an upper end 5*u*1 on the top sealed part 6 side of the inner edge inclined part 5*u* of the inclined sealed part 5 and the lower end 5*u*2 (upper end of the side sealed part 4) on the bottom sealed part 8 side.

The front and back misalignment range S varies depending on various factors such as the distance between the easily-openable part 10 and the inner edge of the top sealed part 6, the shape and dimension of the packaging bag 1, the material and thickness of a film, the magnitude and direction of the force of the fingers when breaking the packaging bag 1 and the speed of breakage. Therefore, the front and back misalignment range S is statistically set from experimental data according to a product.

Since the position of the upper limit Sa of the front and back misalignment range S is restricted by the inner end of the top sealed part 6, the upper limit Sa of the front and back misalignment range S can be raised to the upper end 5*u*1 of the inner edge inclined part 5*u* of the inclined sealed part 5.

On the other hand, the position of the lower limit Sb of the front and back misalignment range S is required to be set such that the lower limit Sb does not reach below the lower end 5*u*2 of the inner edge inclined part 5*u* of the inclined sealed part 5 (upper end of the side sealed part 4).

The front and back misalignment range S is determined by the maximum width D in the unsealing direction of the packaging bag 1. It has been confirmed that, by setting the height (gap) H from the unsealing virtual straight line 12 to the lower end 5*u*2 of the inner edge inclined part 5*u* to be 5/18 or less relative to the maximum width D in the unsealing direction of the packaging bag 1, the inner edge inclined part 5 can cover almost entirely the lower limit Sb of the front and back misalignment range S.

It is preferred that the position of the upper limit Sa of the front and back misalignment range S be set such that it does not interfere the top sealed part 6.

Figure 2A:
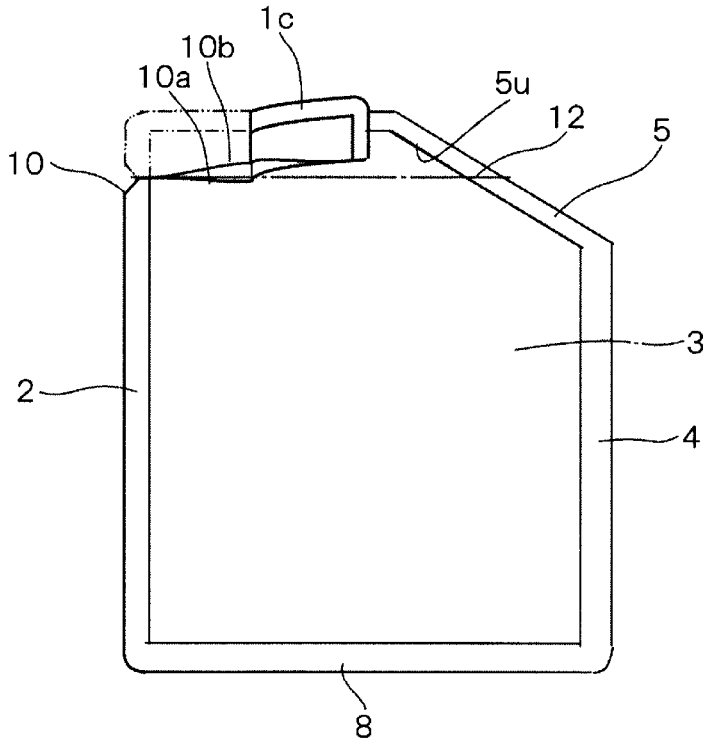
FIGS. 2A to 2C each show the manner of opening of the packaging bag shown in FIG. 1.

Subsequently, with reference to FIG. 2, the unsealing operation of the packaging bag according to the present embodiment will be explained.

First, the easily-openable part 10 of the side sealed part 2 as the sealed part on the unsealing start side of the packaging bag 1 is broken, whereby a first unsealing is conducted.

Then, the broken piece 1*c* on the side of the top sealed part 6 is turned toward the front side or the back side and is pulled in the unsealing direction toward the inclined sealed part 5, which is the sealed part on the unsealing terminal side. As a result, a shearing force is applied to the packaging bag 1 along the unsealing virtual straight line 12, the front film 1*a* and the back film 1*b* that are not heat-sealed in the accommodation part 3 are broken in a state of being superimposed, and a second opening is conducted (see FIG. 2A). Since the unsealing virtual straight line 12 is not weakened as in the case of a perforated line, the break lines of the front film 1*a* and the back film 1*b* often deviate from the unsealing virtual straight line 12.

The break line 10*a* of the front film 1*a* and the break line 10*b* of the back film 1*b* progress while generating front and back misalignments in vertical direction. At the second unsealing stage, the front ends of the break lines 10*a* and 10*b* on the front and back sides simultaneously proceed.

The break line 10*b* of the back film 1*b* that is misaligned upwardly firstly arrives at the inner edge inclined part 5*u* of the inclined sealed part 5 of the unsealing terminal side at the arrival point Pb. Subsequently, the break line 10*b* progresses along the inner inclined part 5*u* of the inclined sealed part 5, and is joined with the break line 10*a* of the front film 1*a* that is misaligned downwardly at the arrival point Pa, whereby the broken piece 1*c* is separated.

If the break line 10*a* of the front film 1*a* and the break line 10*b* of the back film 1*b* are misaligned inversely in the vertical direction, similarly, the upper break line firstly arrives at the inner edge inclined part 5*u* and can be joined with the lower break line. Further, when the inner edge inclined part is inclined in a direction opposite to the above-mentioned inclination, that is, an upper part of the inner peripheral part is inclined towards the unsealing terminal side that is opposite to the accommodation part, the lower break line firstly arrives at the inner edge inclined part, progresses along the inner edge inclined part, and is joined with the upper break line at the arrival point of the upper break line.

Figure 3A:
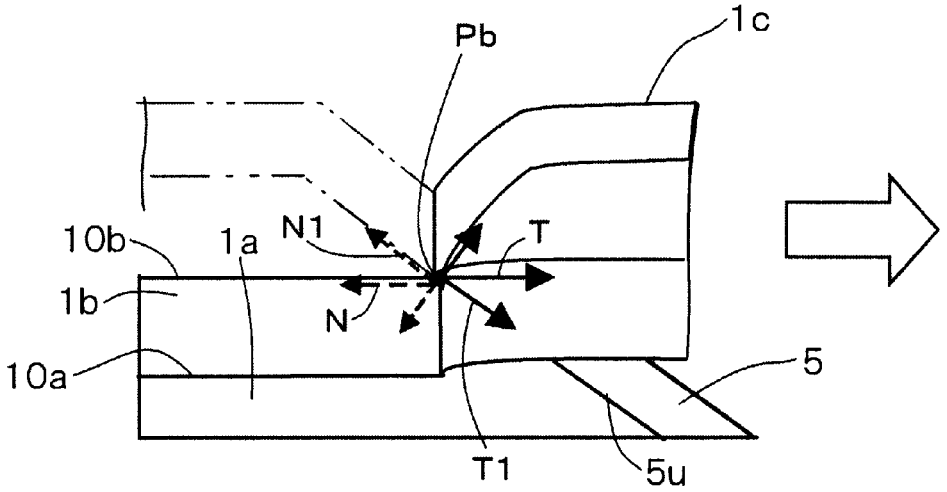
FIGS. 3A to 3D each show the state of breakage in the vicinity of the side sealed part on the unsealing terminal side of the packaging bag according to the first embodiment of the present invention.
Figure 3B:
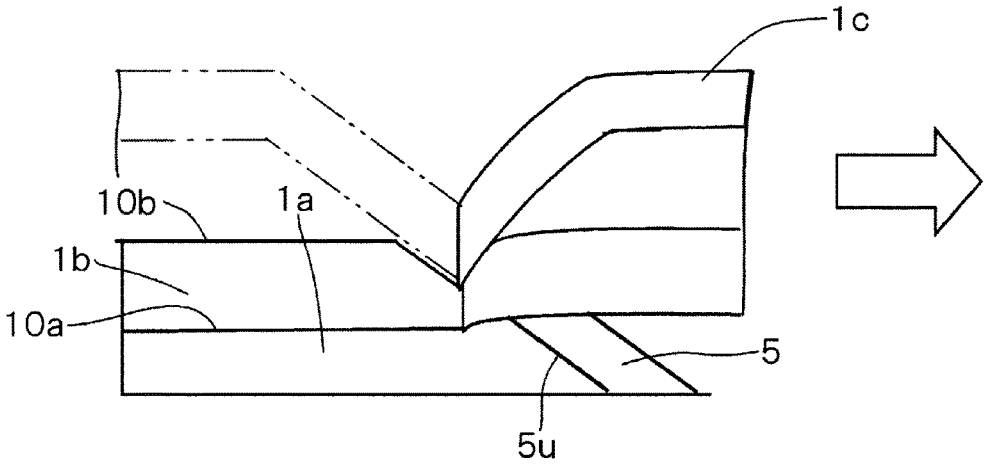

This process of joining will be explained with reference to FIG. 3. FIG. 3A shows a state in which the break line 10*b* of the back film b positioned on the upper side reaches the arrival point Pb of the inner edge inclined part 5*u* of the inclined sealed part 5. If a surface tension T is applied to the break piece 1*c* in this state, the inclined sealed part 5 that has a high tearing force is not tom. Instead, a shearing force ads in a direction along the inner edge inclined part 5*u* of the inclined sealed part 5 due to the component force T1 in the direction along the inner edge inclined part 5*u* of the inclined sealed part 5 having low tearing strength and the reaction force N1. As a result, the break line 10*b* of the back film 1*b* progresses along the inner edge inclined part 5*u* of the inclined sealed part 5 (see FIG. 38).

Figure 3C:
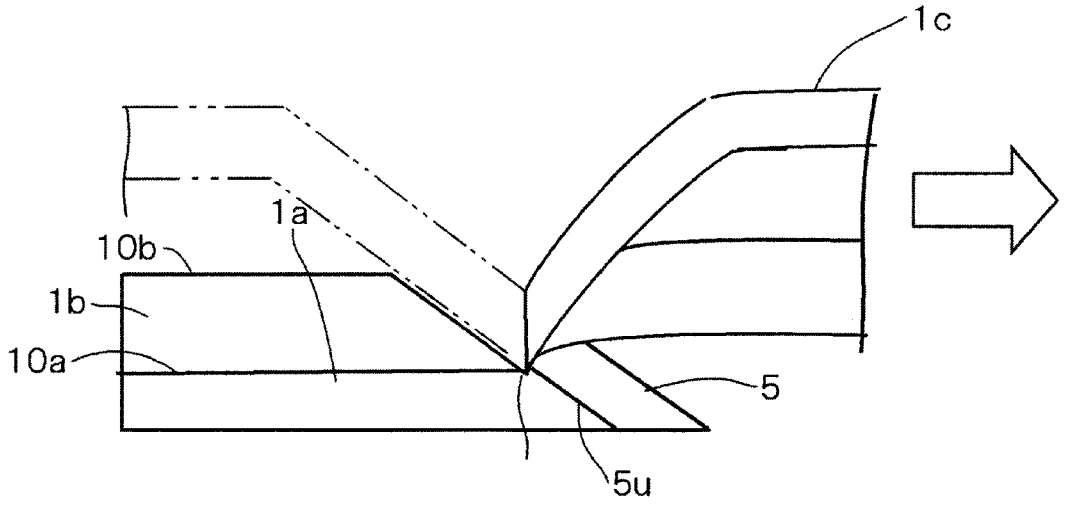
Figure 3D:
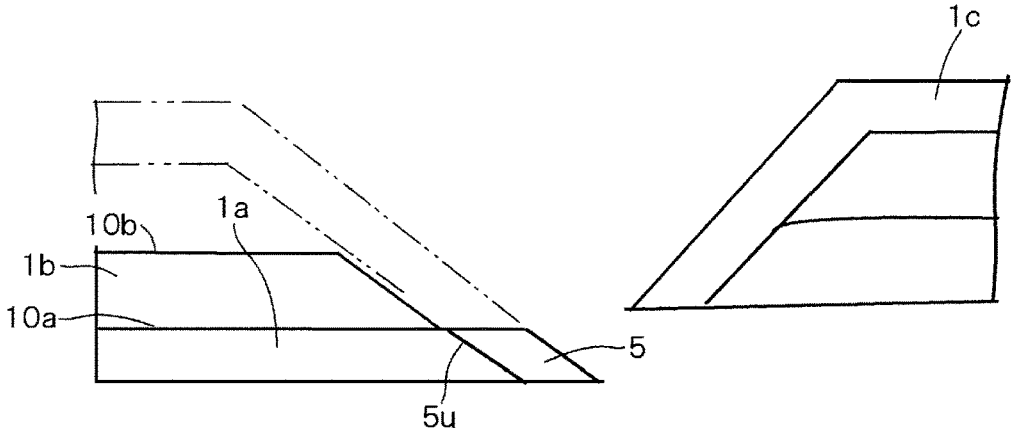

Simultaneously with the progress of the upper break line 10*b*, the lower break line 10*a* progresses in the tensile direction of the break piece 1*c*, and is joined with the upper break line 10*b* at the arrival point Pa of the inner edge inclined part 5*u* of the inclined sealed part 5 of the lower break line 10*a* (see FIG. 3C).

Further, when the broken piece 1*c* is pulled, the tensile strength T and the reaction force acting on the front film 1*a* and the back film 1*b* superimposed on the side of the accommodation part 3 intensively ad at the arrival point Pa where the lower break line 10*a* and the upper break line 10*b* are joined. As a result, third opening to break the inclined sealed part 5 is conducted, whereby the broken piece 1*c* is completely separated (see FIG. 3D). Further, in order to separate the broken piece 1*c* with a small tensile force T, the width of the inclined sealed part 5 is preferably 5 to 15 mm. The larger the width of the inclined sealed part 5, the larger the tensile force T at the third opening is required. If the width of the inclined sealed part 5 is small, the packaging bag 1 may be tom by impact such as falling.

As mentioned above, if the break line causes front and back misalignment during a period of time from the first unsealing to the second unsealing of the packaging bag 1, in the third unsealing, the break lines are joined at one arrival point. As a result, the packaging bag 1 can be smoothly broken without need of an excessive force.

Next, an explanation will be made on a virtual opening width W along the virtual unsealing line 12 that is a gap between the side sealed part 2 on the unsealing start side and an inner edge of the inclined sealed part 5 on the unsealing terminal side and the angle θ made by the inner edge inclined part 5*u* of the inclined sealed part 5 and the unsealing virtual straight line 12.

Since the pouring property of contents is lowered if the width of the opening after unsealing is lowered, it is preferred that the virtual opening width W be about 35 mm or more. If the virtual opening width W is less than 35 mm, the front and back misalignment of the break lines hardly occurs. On the other hand, if the virtual opening width W is 35 mm or more, the front and back misalignment of the break lines tends to occur easily, and as a result, the effects of the inner edge inclined part of the present invention can be fully exhibited.

The angle θ made by the inner edge inclined part 5*u* of the inclined sealed part 5 and the unsealing virtual straight line 12 is an acute angle made by the inner edge inclined part 5*u* that passes the arrival point Pb at which the break line 10*b* arrives first and the arrival point Pa at which the break lines are joined and the unsealing virtual straight line 12 (FIG. 3). Further, when the inner edge inclined part 5*u* is inclined towards the unsealing terminal side opposing to the accommodation part, and when unsealing, the break line at the lower side (bottom side) arrives at the inner edge inclined part 5*u* first at the time of unsealing, and the break line is joined with the upper arrival point from the lower arrival point, the acute angle made by the inner edge inclined part 5*u* from the lower side to the upper side and the unsealing virtual straight line 12 is the angle θ (see FIG. 4E).

As mentioned above, it is required to generate a component force for breaking the packaging bag 1 from the arrival point at which one break line arrives the inner edge inclined part at first to the arrival point at which two break lines are joined, it suffices that the angle θ be basically an acute angle. The angle θ may be 60° or less, more preferably 45° or less in order to allow the component force to be a certain level or more. However, if the angle θ becomes small, the width of the opening becomes narrow, the angle θ is preferably 20° or more.

In the packaging bag of the present invention, the inner edge inclined part on the unsealing terminal side may at least be a straight line that is inclined by a prescribed angle relative to the unsealing direction or a curved line having a tangent line inclined by a prescribed angle with respect to the unsealing direction in the front and back misalignment range of the break lines of the front film and the back film, and various modifications are possible as mentioned below.

FIGS. 4A to 4F and FIGS. 5A to 5F show modification examples of the above-mentioned embodiments. In the following explanation, only parts differing from those in the packaging bag in the above-mentioned embodiments are explained, and the same elements are indicated by the same numerical references, and an explanation thereof is omitted.

Figure 4A:
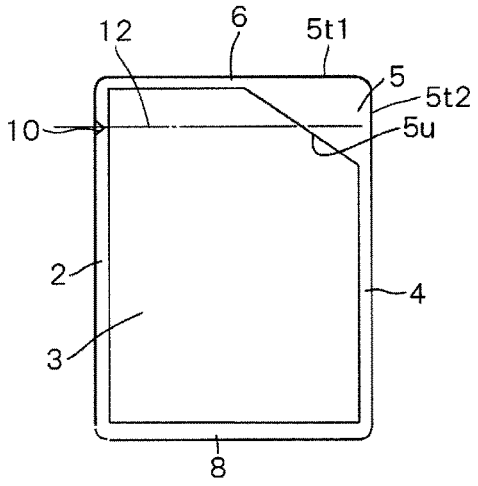
FIGS. 4A to 4F each show a modification example of the first embodiment.

In the inclined sealed part 5 shown in FIG. 4A, the outer edge 5*t* and the inner edge inclined part 5*u* are not in parallel with each other, and has a right triangle shape formed by the inner edge inclined part 5*u*, the extension line 5*t*1 of the outer edge of the top sealed part 6, the extension line 512 of the outer edge of the side sealed part 4. In this modification example, the inclined sealed part 5 is wide, but by the break line that is joined along the inner edge inclined part 5*u*, the third unsealing of the inclined sealed part 5 is conducted smoothly.

Figure 4B:
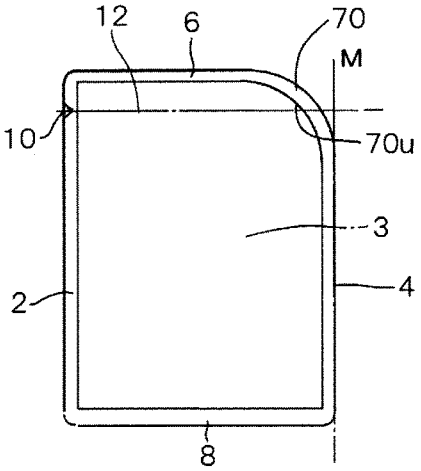

The inner edge inclined part 70*u* of the inclined sealed part 70 shown in FIG. 4B does not have a linear shape but has a shape that is curved such that it has a convex shape towards the outside of the accommodation part 3. The tangent line of the inner edge inclined part 70*u* is inclined by a predetermined angle with respect to the unsealing virtual straight line 12. In this modification example, after the upper break line reaches the inner edge inclined part 70*u* of the inclined sealed part 70, the packaging bag can be broken more smoothly up to the arrival point of the lower break line.

Figure 4C:
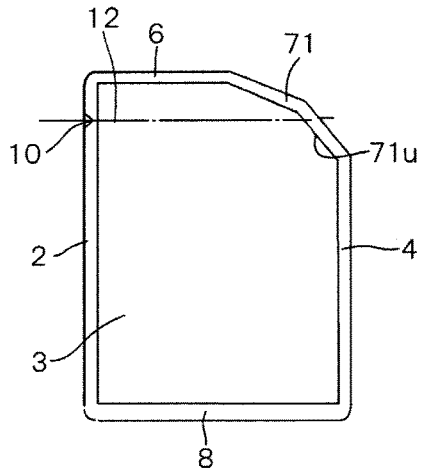

The inner edge inclined part 71*u* of the inclined sealed part 71 shown in FIG. 4C is not a single inclined straight line, but has a polygonal line shape connecting a plurality of linear portions having mutually different inclination angles.

Figure 4D:
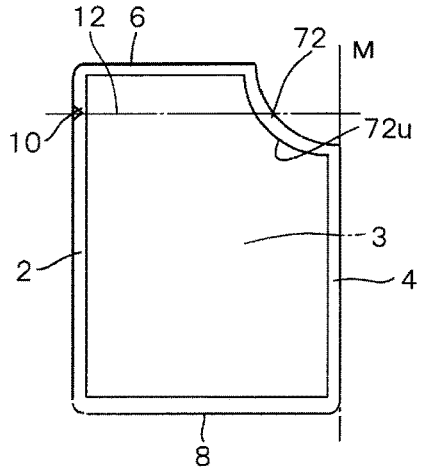

The inner edge inclined part 72*u* of the inclined sealed part 72 shown in FIG. 4D has a curved shape that is curved such that it has a convex shape towards the inside of the accommodation part 3. The tangent line of the inner edge inclined part 72*u* is inclined by a predetermined angle with respect to the unsealing virtual straight line 12.

Figure 4E:
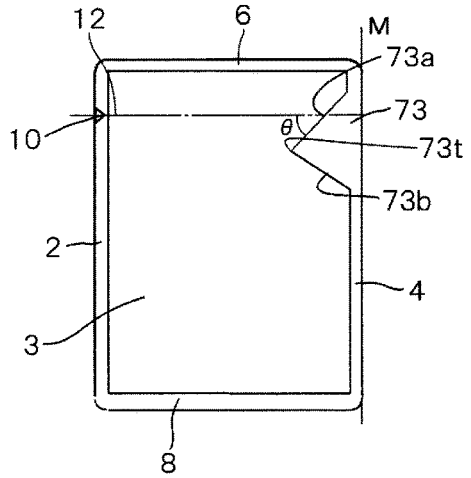

The inclined sealed part 73 shown in FIG. 4E is a mountain-shaped sealed part 73 having a triangular shape protruding towards the accommodation part 3 side. The mountain-shaped sealed part 73 has a linear first inner edge inclined part 73*a* above a top part 73*t* and a linear second inner edge inclined part 73*b* below the top part 73*t*. As it progresses from the top part 73*t* upwardly, the first inner edge inclined part 73*a* is inclined in a direction opposite to the accommodation part 3. As it progresses from the top part 73*t* downwardly, the second inner edge inclined part 73*b* is inclined in a direction opposite to the accommodation part 3. In this modification example, depending on the position of the easily-openable part 10 on the unsealing start side, the front and back misalignment range is required to be set to either one of the first inner edge inclined part 73*a* and the second inner edge inclined part 73*b*.

Figure 4F:
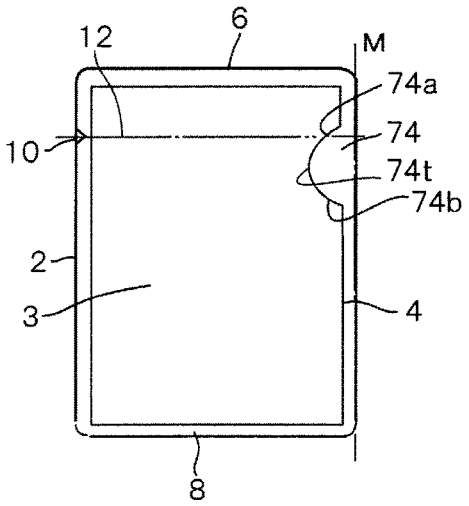

The inclined sealed part 74 shown in FIG. 4F is a curved sealed part 74 having a convexly curved semi-circular shape at the accommodation part side. The curved sealed part 74 has a first inner edge inclined part 74*a* that is above a top part 74*t* and a second inner edge inclined part 74*b* that is below the top part 74*t*. The tangent lines of the first and second inner edge inclined parts 74*a* and 74*b* are inclined by a predetermined angle with respect to the unsealing virtual straight line 12. In this modification example, depending on the position of the easily-openable part 10 on the unsealing start side, the misalignment range is required to be set to be either one of the first inner edge inclined part 74*a* or the second inner edge inclined part 74*b*.

In the above-mentioned modification example, the inner edge inclined part has a shape that protrudes to the accommodation part 3. In the modification example that will be explained below with reference to FIGS. 5A to 5F, the inner edge inclined part has a shape that protrudes outwardly such that it opposes to the accommodation part 3.

Figure 2B:
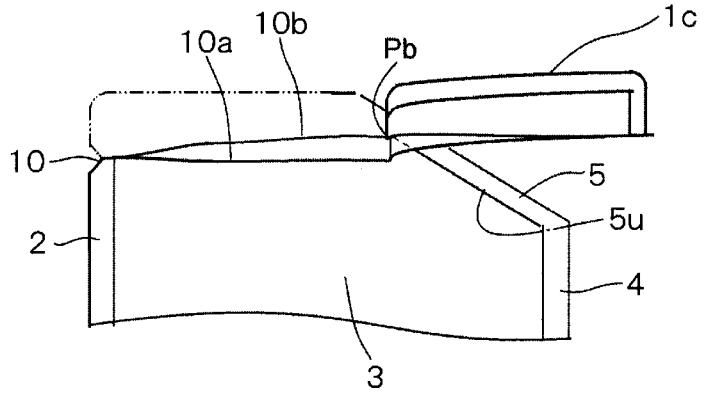
Figure 2C:
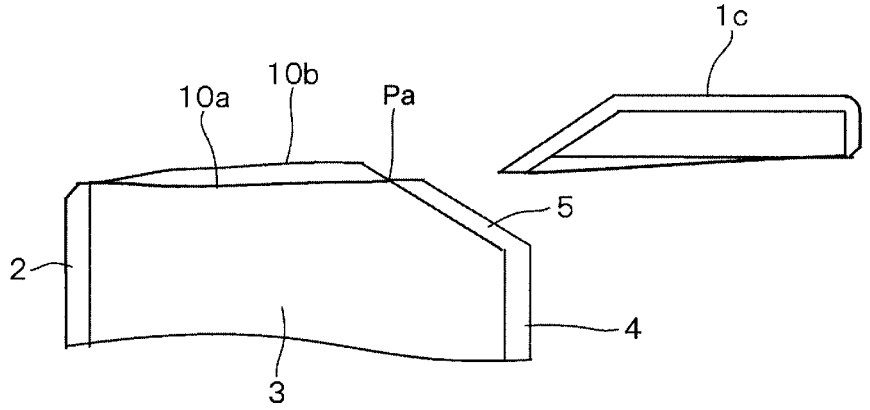
Figure 5A:
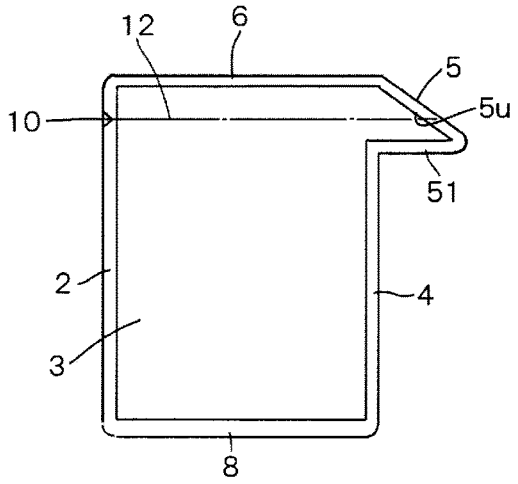
FIGS. 5A to 5F each show a further modification example of the first embodiment.

In the modification example shown in FIG. 5A, the inclined sealed part 5 in the embodiment shown in FIG. 2 is provided on an extended part 51 that extends to a side opposite to the accommodation part 3.

Figure 5B:
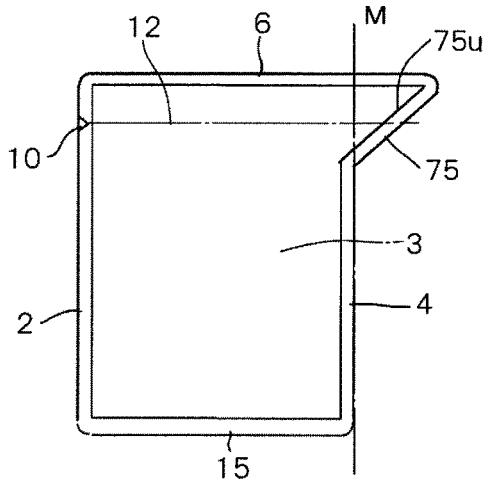

The packaging bag shown in FIG. 5B has an inversely inclined sealed part 75 that is obtained by inversing the inclined sealed part 5 of the embodiment shown in FIG. 1 line-symmetrically with respect to an extension line M that is formed by extending the outer edge of the side sealed part 4. The direction of inclination of the inversely inclined sealed part 75 and the inclined sealed part 5 is opposite. In this modification example, the lower break line arrives first the inner edge inclined part 75*u* of the inversely inclined sealed part 75, and progresses towards the arrival point of the upper break line.

Figure 5C:
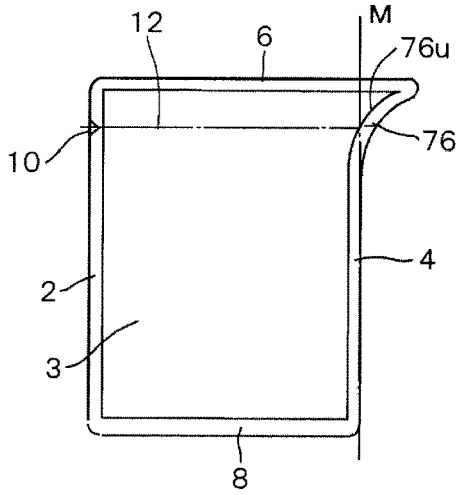

The packaging bag shown in FIG. 5C has an inversely inclined sealed part 76 obtained by line-symmetrically inversing the curved inclined sealed part 70 shown in FIG. 4B relative to the extension line M. The inversely inclined sealed part 76 has a curved inner edge inclined part 76*u*.

Figure 5D:
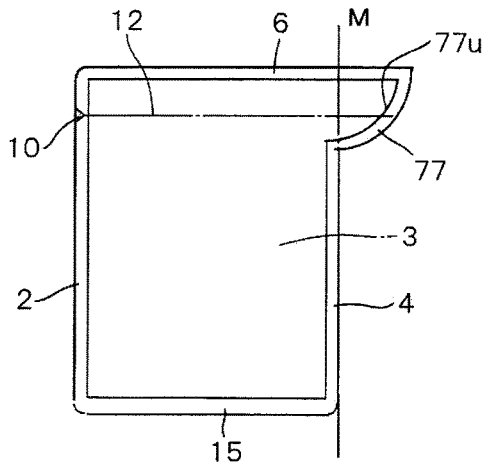

The packaging bag shown in FIG. 5D has an inversely inclined sealed part 77 obtained by line-symmetrically inversing the curved inclined sealed part 71 shown in FIG. 4C relative to the extension line M. The inversely inclined sealed part 77 has a curved inner edge inclined part 77*u*.

Figure 5E:
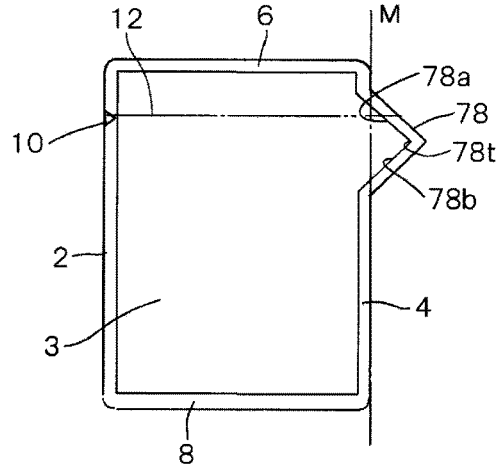

The packaging bag shown in FIG. 5E has an inversely mountain-shaped sealed part 78 that is obtained by line-symmetrically inversing the mountain-shaped sealed part 73 shown in FIG. 4E relative to the extension line M. The inversely mountain-shaped sealed part 78 has a linear first inner edge inclined part 78*a* above the top part 78*t* and a linear second inner edge inclined part 78*b* below the top part 78*t*. The first inner edge inclined part 78*a* is inclined towards the accommodation part as it progresses upwardly from the top part 78*t*. The second inner peripheral part 78*b* is inclined towards the accommodation part as it progresses downwardly from the top part 78*t*.

Figure 5F:
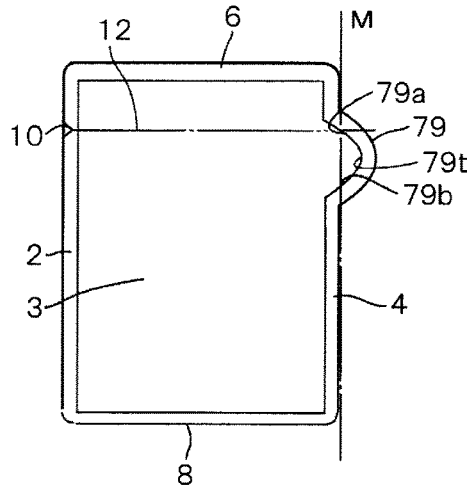

The packaging beg shown in FIG. 5F has an inversely curved sealed part 79 that is obtained by inversing the curved sealed part 74 shown in FIG. 4F relative to the extension line M. The curved sealed part 79 has a first inner edge inclined part 79*a* above the top part 79*t* and a second inner edge inclined part 79*b* below the top part 79*t*.

Second Embodiment

Figure 6:
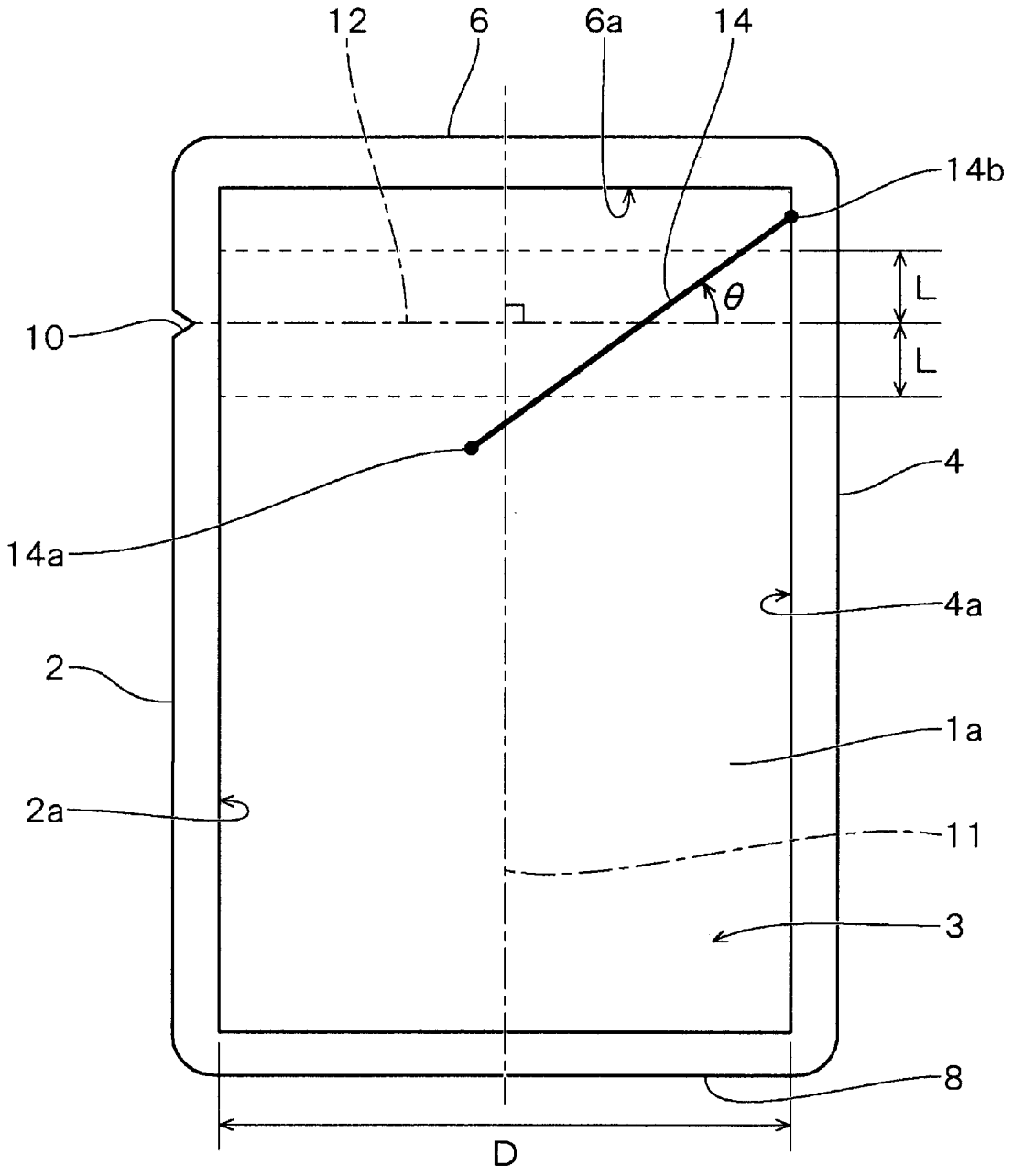
FIG. 6 shows a plan view of the packaging beg according to a second embodiment of the present invention.

FIG. 6 shows a plan view of the packaging bag of the second embodiment. The packaging bag of the present embodiment is a flat pouch obtained by heat sealing the four sides of the front film 1*a* and the back film 1*b* superimposed (see FIGS. 9 to 12) by the top sealed part 6 on the upper edge and the bottom sealed part 8 on the lower edge (bottom) with a pair of side sealed parts 2 and 4 and a side to which an opening port is planned to be formed (opening side) being positioned on the upper side. Between the front film 1*a* and the back film 1*b* in a region surrounded by these sealed parts 2, 4, 6 and 8, the contents are packed and sealed.

The front film 1*a* and the back film 1*b* are each formed of a laminate film obtained by superimposing a nylon layer on a polyolefin layer, for example.

For the front film 1*a* and the back film 1*b*, various materials and configurations enabling heat sealing can be adopted. For example, the front film 1*a* and the back film 1*b* may be composed of a single layer film formed of a thermoplastic resin capable of being heat sealed, or may be formed of a laminate film of which the surface to be heat-sealed is formed of a heat-sealable resin. The laminated film may have a laminate structure in which a barrier layer is provided in the intermediate layer or a laminate structure in which a barrier layer is provided in the surface layer. In the laminate film, a resin layer may be used as a base material, or paper may be used as a base material.

In the accommodation part 3 that is an unsealed region between the pair of side sealed parts 2 and 4 of the front film 1*a* and the back film 1*b*, a front unsealing guide line 14 provided in the front film 1*a* and a back unsealing guide line 14 provided on the back film 1*b* are provided. In FIG. 6, the front unsealing guide line and the back sealing guide line 14 are superimposed and shown by a single line.

The front unsealing guide line and the back unsealing guide line 14 obliquely cross the unsealing virtual straight line 12, and extend along the direction from the lower left to the upper right. The unsealing virtual straight line 12 is a virtual line along an unsealing direction in which the part 1*c* above the easily-openable part 10 (hereinafter referred to as "broken piece") is pulled with fingers when unsealing is conducted from the easily-openable part 10 in the form of a notch formed on the side sealed part 2 on the unsealing start side (hereinafter also referred to as "left side sealed part") to the side sealed part 4 on the unsealing terminal side (hereinafter referred to as the "right side sealed part").

When the packaging bag has a rectangular shape having a pair of side sealed parts 2 and 4 that are in parallel with each other and the top sealed part 6 that extends orthogonally cross these sealed parts as in the present embodiment, as shown in FIG. 6, the unsealing virtual straight line 12 orthogonally crosses a symmetrical axis line 11 that extends in parallel with the pair of side sealed parts 2 and 4, and the unsealing virtual straight line 12 extends in parallel with the linear lower edge 6*a* of the top sealed part 6.

The angle θ formed by each of the front unsealing guide line 14 and the back unsealing guide line 14 and the unsealing virtual straight line 12 is preferably 10 to 50°, more preferably 20 to 45°. If the angle θ is larger than 50°, when unsealing, among the puling forces along the unsealing virtual straight line 12, the component force in the direction along the unsealing guide line 14 becomes small, and as a result, it becomes difficult to tear along the unsealing guide line 14. On the other hand, if the angle θ becomes smaller than 10°, there is a high possibility that the break line does not arrive at the unsealing guide line 14.

The end 14*b* (hereinafter referred to as "terminal end") closer to the right side sealed part 4 (the unsealing terminal side) of each of the front unsealing guide line and the back unsealing guide line 14 are superimposed on the inner edge 4*a* of the right side sealed part 4. As a result, at the time of unsealing, the break line 10*a* of the front film 1*a* and the break line 10*b* of the back film 1*b* are directly induced to a single point on the inner edge 4*a* of the right side sealed part 4 by the front unsealing guide line and the back unsealing guide line 14.

The terminal end 14*b* is not necessarily positioned on the inner edge 4*a* of the right side sealed part 4 as long as it can induce the break line 10*a* of the front film 1*a* and the break line 10*b* of the back film 1*b* to a single point of the inner edge 4*a* of the right side sealed part 4, and it may be positioned in the vicinity of the inner edge 4*a*. Here, it is preferred that the terminal end 14*b* in the vicinity of the inner edge 4*a* be positioned within a distance of 10 mm or shorter from the inner edge 4*a*. The same can be applied to other embodiments mentioned later.

Further, the end 14*a* (hereinafter referred to as "start end") closer to the left side sealed part 2 of each of the front unsealing guide line and the back unsealing guide line 14 is positioned downwardly for a predetermined distance L or longer from the unsealing virtual straight line 12. On the other hand, the end (terminal end) 14*b* closer to the right side part 4 of the unsealing guide line 14 is positioned upwardly for a predetermined distance L or longer from the unsealing virtual straight line 12.

Here, the prescribed distance L is set to be preferably 28% or longer, further preferably 38% or longer of the length D along the unsealing virtual straight line 12 between the inner edges 2*a* and 4*a* of the pair of side sealed parts 2 and 4 (the same can be applied to other embodiments mentioned later). This ratio of the distance relative to the length D is experimentally obtained such that it includes a range when break lines are formed when unsealing a packaging bag. By arranging the start end 14*a* and the terminal end 14*b* of each of the front unsealing guide line and the back unsealing guide line 14 at a position remote from the unsealing virtual straight line 12 for a prescribed distance L or longer, the possibility that the break line arrives at the unsealing guide line 14 at the time of unsealing can be increased.

Figure 7:
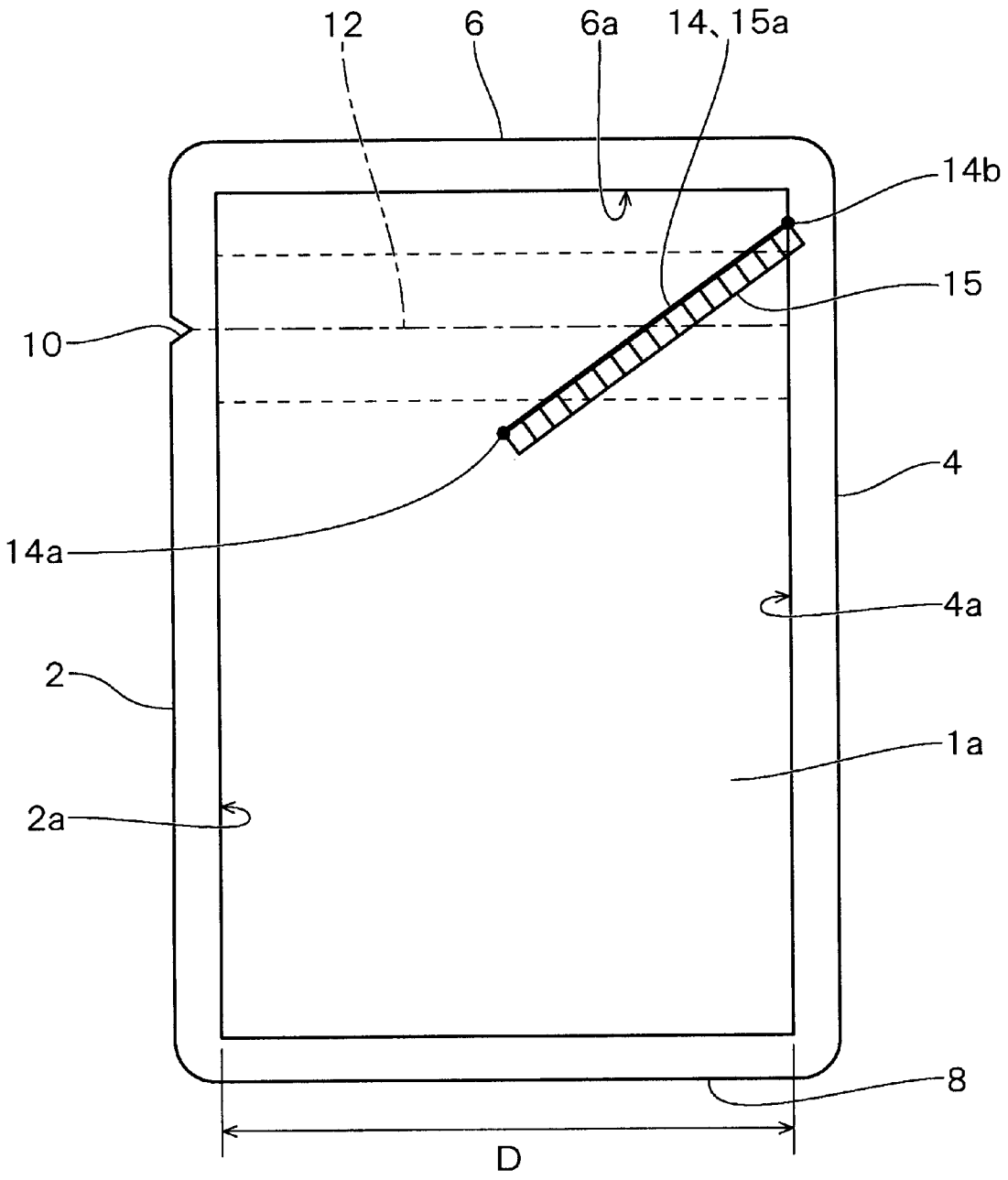
FIG. 7 shows a plan view showing the structure of an unsealing guide line in the packaging bag according to the second embodiment of the present invention.

FIG. 7 shows one example of the front unsealing guide line and the back unsealing guide line 14. The front unsealing guide line and the back unsealing guide line 14 shown in FIG. 7 is composed of an edge 15*a* of a reinforced part 15 that is hardly broken as compared with the front film 1*a* and the back film 1*b*. The reinforced part 15 may be formed by partially heat sealing or adhering the front film 1*a* and the back film 1*b*, or may be formed by providing an element or a tape on the outer surface, the inner surface or between the layers of each of the front film 1*a* and the back film 1*b*. When the front film 1*a* and the back film 1*b* are partially heat-sealed or adhered, edges of parts at which the front film 1*a* and the back film 1*b* are heat-sealed or adhered respectively function as the front unsealing guide line and the back unsealing guide line 14. The break line that arrives at the edge 15*a* of the reinforced part 15 at the time of unsealing, since the reinforced part 15 is hardly broken, the break line progresses along the edge 15*a* of the reinforced part 15. Therefore, the edge 15*a* of the reinforced part 15 functions as the front unsealing guide line and the back unsealing guide line 14 mentioned above.

Further, the front unsealing guide line and the back unsealing guide line 14 may be composed of a weakened part that is easily broken as compared with the front film 1*a* and the back film 1*b*. Since the break line that arrives at the weakened part at the time of unsealing progresses along the weakened part that is easier to be broken as compared with surrounding parts, the weakened part functions as the front unsealing guide line and the back unsealing guide line 14. The weakened part can be formed in each of the front film 1*a* and the back film 1*b* as a non-through half-cut processing part. The half-cut processing part can be formed by laser processing, a knife processing using a roll provided with fine blades at its surface or a punching die and polishing processing in which pressing is conducted by a roll with highly hard abrasive. An appropriate method is selected from these methods to form a linear or perforated non-through half-cut processing part.

In the present embodiment, an explanation is made on the assumption that the front unsealing guide line 14 that induces the break line 10*a* of the front film 1*a* and the back unsealing guide line 14 that induces the break line 10*b* of the back film 1*b* are formed integrally such as a heat-sealed part or that the front unsealing guide line 14 formed on the front film 1*a* and the back unsealing guide line 14 formed on the back film 1*b* are formed on a position where they are superimposed. The same can be applied to the following embodiments.

Figure 8:
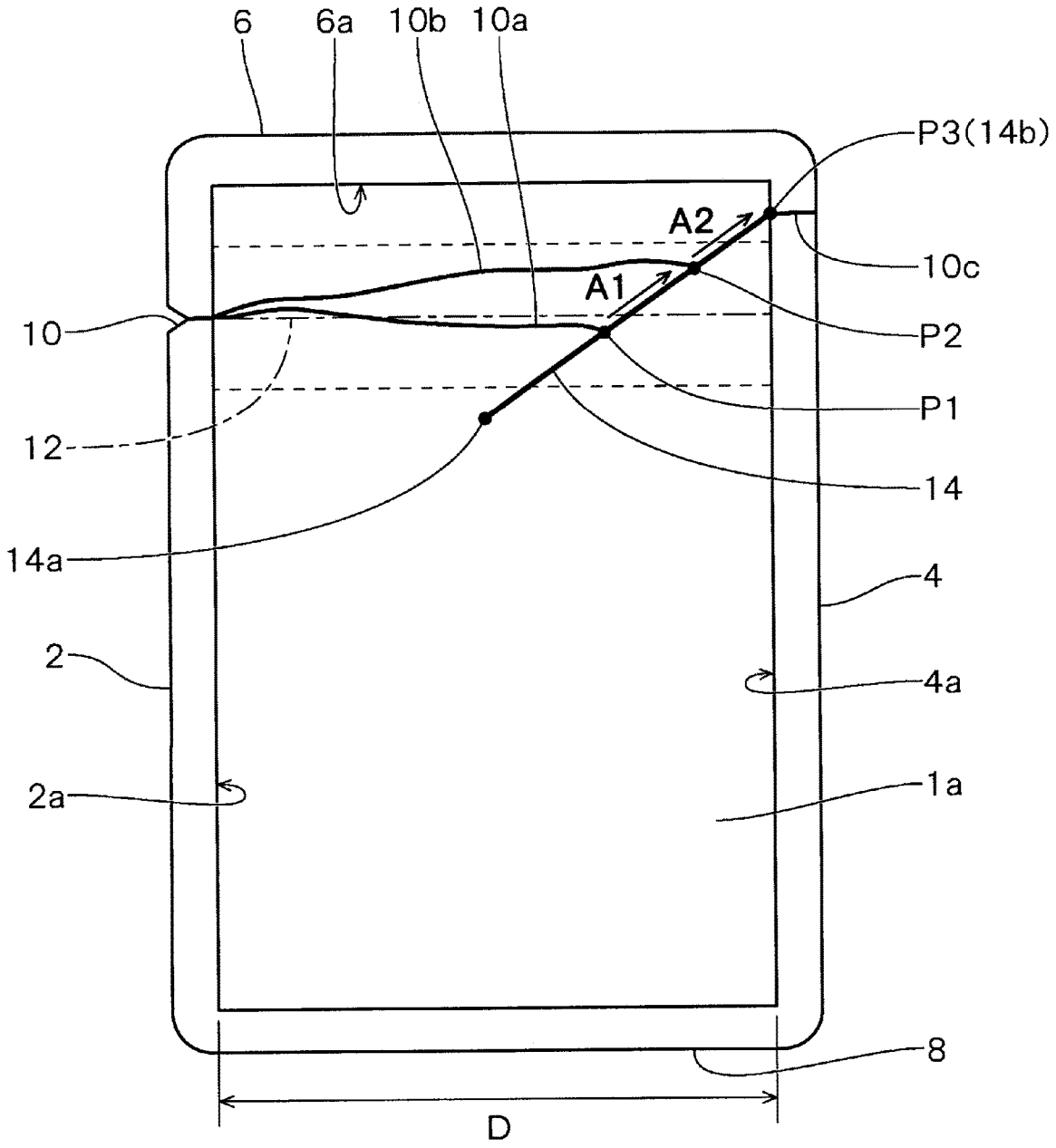
FIG. 8 shows a plan view for explaining the guide of the break line by the unsealing guide line at the time of unsealing in the packaging bag according the second embodiment of the present invention.

Hereinbelow, unsealing of the packaging bag of the present embodiment will be explained with reference to FIGS. 8 to 12. FIG. 8 shows the position of the break line 10*a* of the front film 1*a* (hereinafter referred to as "front break line") at the time of unsealing and the break line 10*b* of the back film 1*b* (hereinafter referred to as "back break line") are shown in a manner that they are overlapped on the packaging beg in a sealed state.

When the packaging bag is unsealed from the easily-openable part 10 on the left side sealed part 2 to the right side sealed part 4, by pulling a part above the easily-openable part 10 towards the right side sealed part 4 with fingers, the left side sealed part 2 is tom from the easily-openable part 10. Then, a part above the easily-openable part 10 becomes the broken piece 1*c*.

When the broken piece 1*c* is further pulled to the right, the front film 1*a* and the back film 1*b* are opened in the accommodation part between the pair of side sealed parts 2 and 4, and the front broken line 10*a* and the back broken line 10*b* extend to the right side sealed part 4. At this time, as shown in FIG. 8, the front and back misalignment in which the front break line 10*a* and the back break line 10*b* are vertically misaligned occurs.

Figure 9:
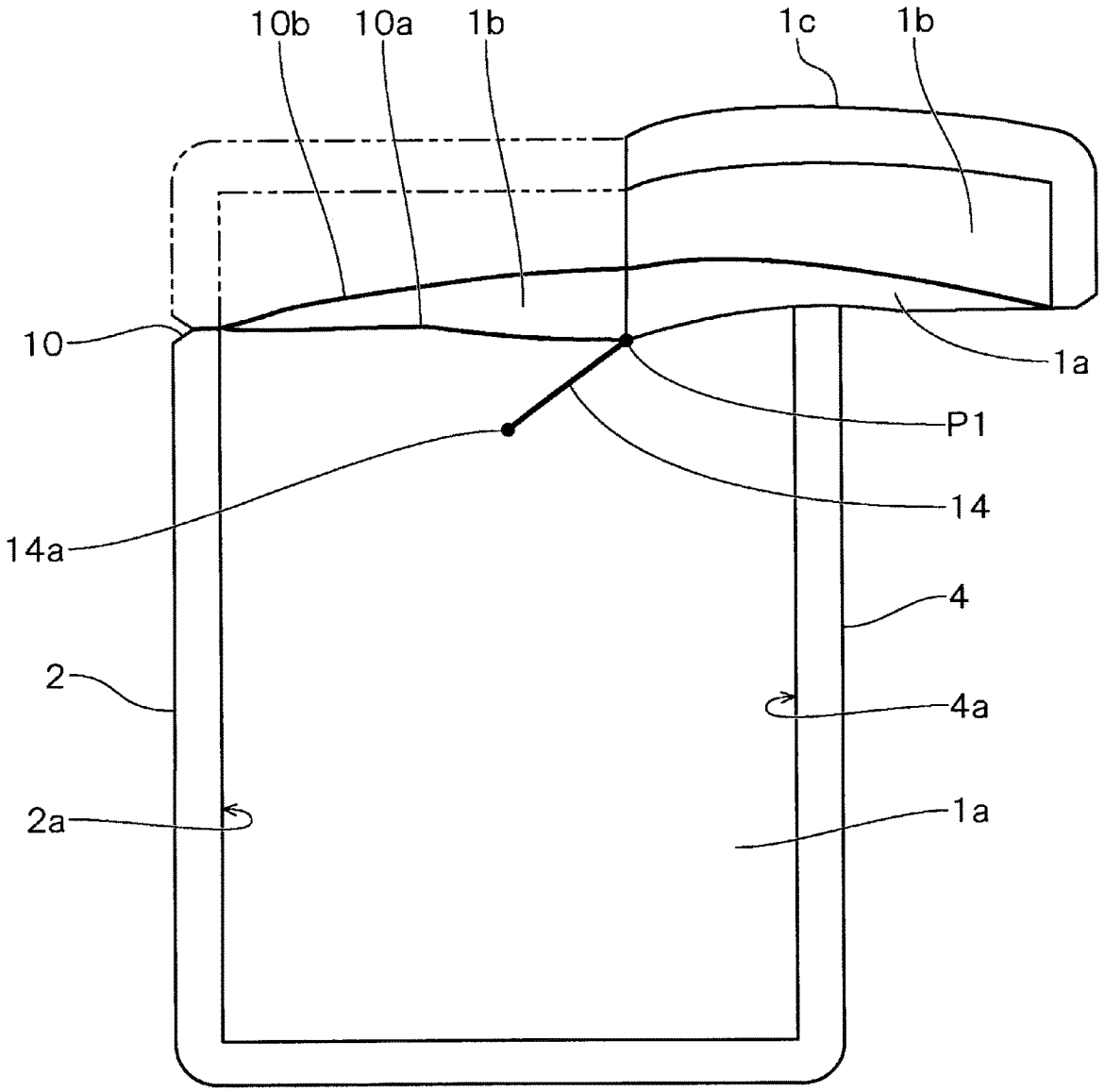
FIG. 9 shows a state of unsealing the packaging bag according to the second embodiment of the present invention.

In the present embodiment, as shown in FIG. 9, the front break line 10*a* of the front film 1*a* firstly arrives at the point P1 on the unsealing front guide line 14. The front break line 10*a* that arrives at the point P1 progresses in a direction indicated by an arrow A1 in FIG. 8 along the front unsealing guide line 14.

Figure 10:
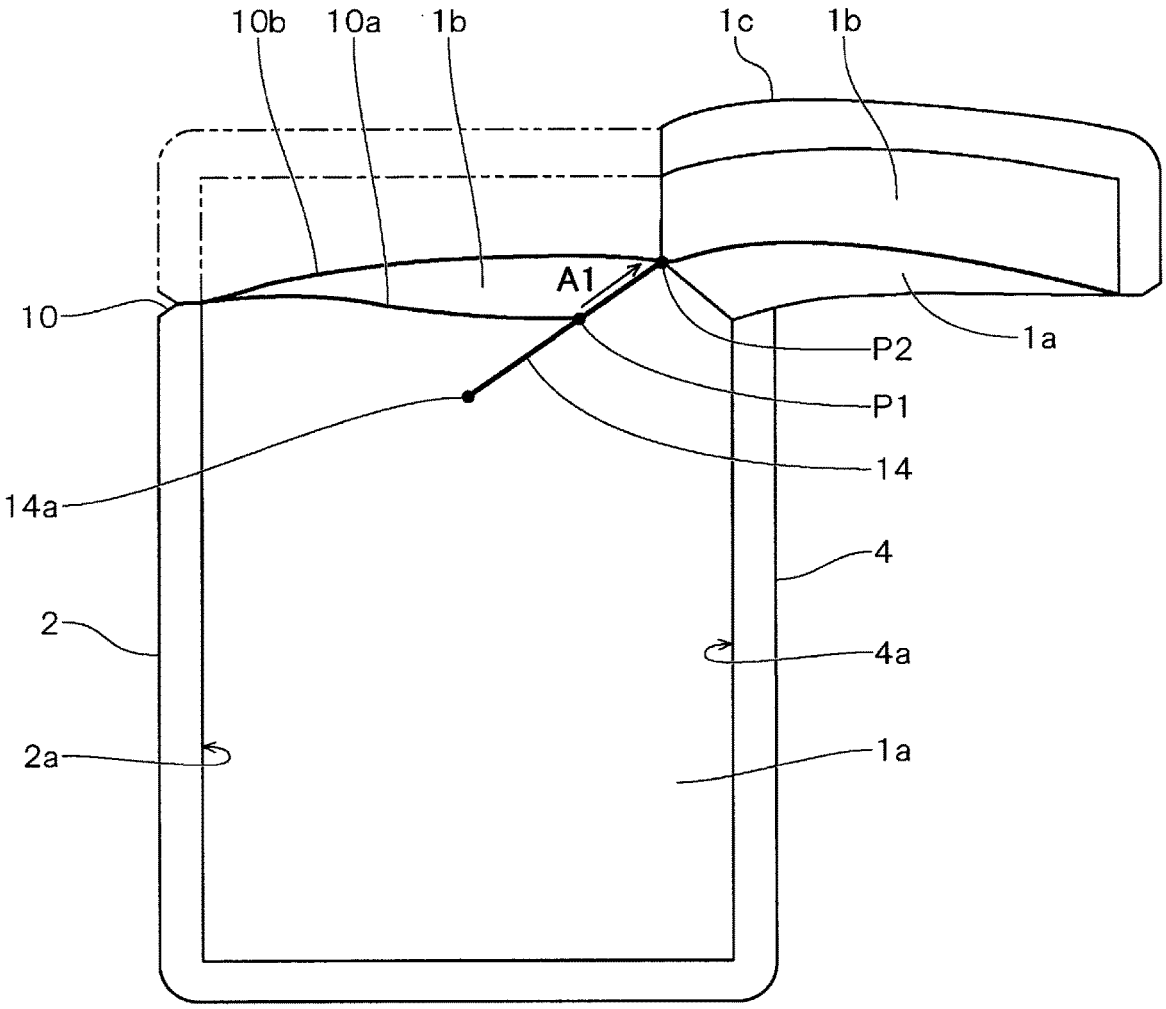
FIG. 10 shows a state of unsealing the packaging bag according to the second embodiment of the present invention.

Subsequently, as shown in FIG. 10, the back break line 10*b* arrives at the point P2 on the unsealing back guide line 14, and is joined with the front break line 10*a* that has progressed along the front unsealing guide line 14. The front break line 10*a* and the back break line 10*b* that are joined at the point P2 progress in a direction indicated by an arrow A2 in FIG. 8 along the front unsealing guide line and the back unsealing guide line 14.

Figure 11:
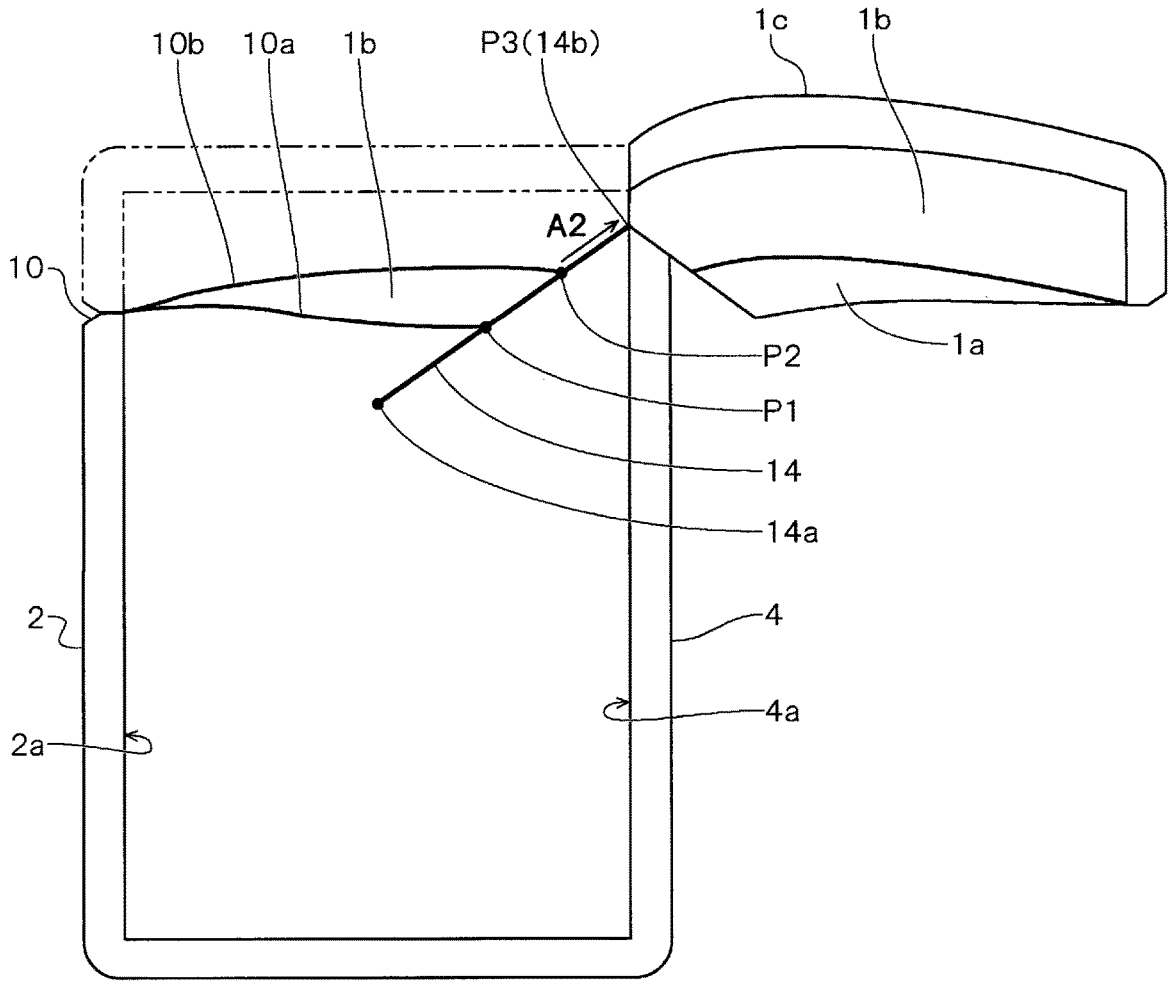
FIG. 11 shows a state of unsealing the packaging bag according to the second embodiment of the present invention.

As shown in FIG. 11, both the front break line 10*a* and the back break line 10*b* arrive at the terminal end 14*b* of each of the front unsealing guide line and the back unsealing guide line 14. These terminal ends 14*b* are arranged on the point P3 on the inner edge 4*a* of the right side sealed part 4 in a superimposed manner. For this reason, the front break line 10*a* and the back break line 10*b* are directly induced to the point P3 that is the same point on the inner edge 4*a* of the right side sealed part 4 by the front unsealing guide line and the back unsealing guide line 14.

Figure 12:
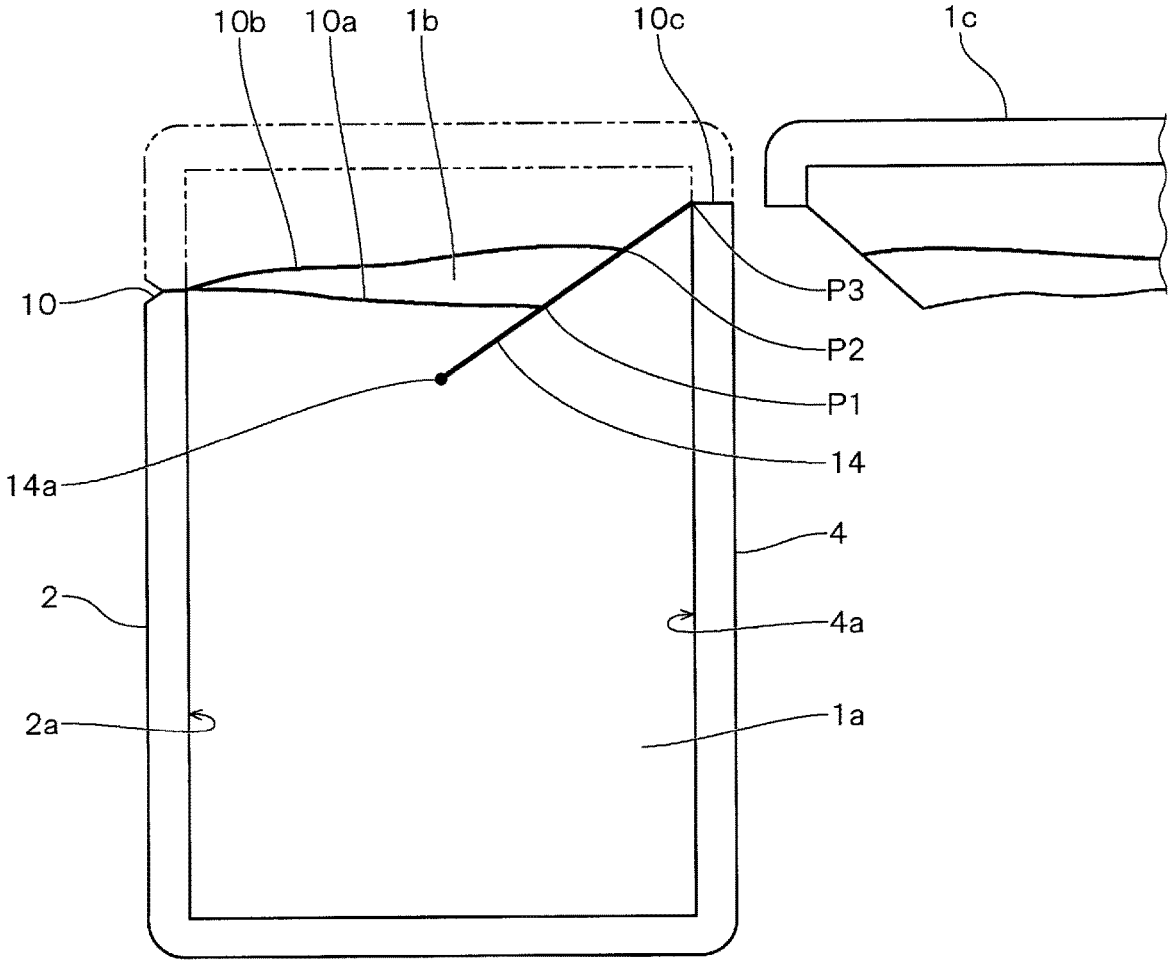
FIG. 12 shows a state of unsealing the packaging bag according to the second embodiment of the present invention.

When the broken piece 1*c* is further pulled to the right side of the figure, as shown in FIG. 12, a single break line

10*c* that is formed by joining of the front break line 10*a* and the back break line 10*b* extends from the point P3 to the right side sealed part 4, whereby the right side sealed part 4 is broken. At this time, since the number of the break line 10*c* on the right side sealed part 4 is only one, there is no need to peel the front film 1*a* from the back film 1*b* with a large force on the right side sealed part 4, and the right side sealed part 4 can be tom off with only a small shear strength. As a result, the broken piece 1*c* can be separated easily.

Further, as shown in FIG. 6, since the front unsealing guide line and the back unsealing guide line 14 extend in a direction from the lower left to the upper right, the front break line 10 and the back break line 10*b* that arrive at the unsealing guide line 14 from the left side are induced to a position above the arrival point along the front unsealing guide line and the back unsealing guide line 14. As a result, the front break line 10*a* and the back break line 10*b* do not progress to a position lower than the front unsealing guide line and the back unsealing guide line 14, whereby leakage of contents by breakage of the packaging bag to a range below the upper surface of the contents can be prevented.

Modification Example

In the second embodiment mentioned above, an example is shown in which the front unsealing guide line 14 that induces the front break line 10*a* and the back unsealing guide line 14 that induces the back break line 10*b* are integrated or are arranged in a superimposed manner. However, these front unsealing guide line and the back unsealing guide line 14 may be arranged separately.

Figure 13:
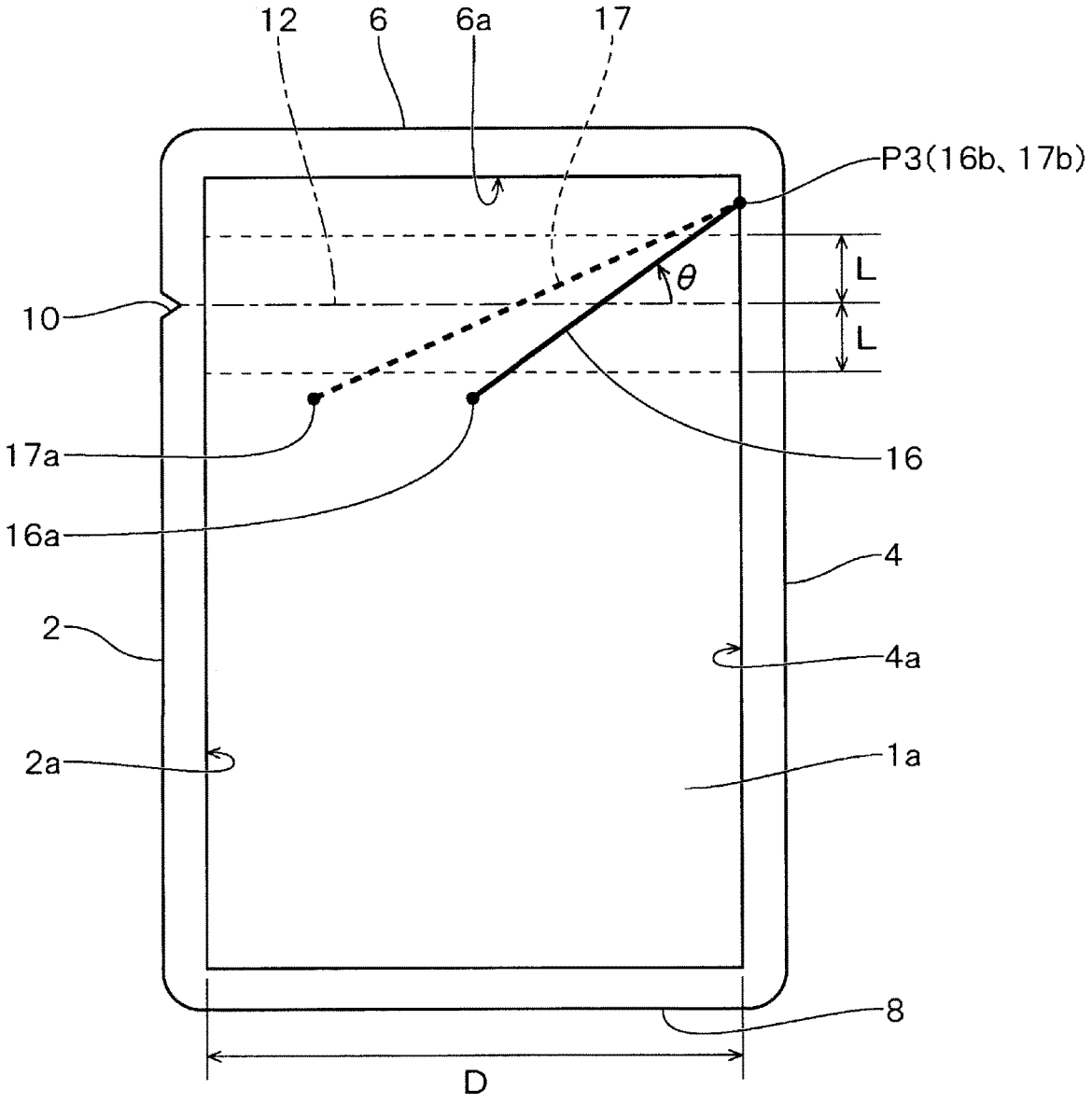
FIG. 13 shows a plan view of a modification example of the packaging bag according to the second embodiment of the present invention.

FIG. 13 shows a modification example of the second embodiment. In the present modification example, as for the front unsealing guide line and the back unsealing guide line, the front unsealing guide line 16 that induces the break line (front break line) 10*a* of the front film 1*a* and the back unsealing guide line 17 that induces the break line (back break line) 10*b* of the back film 1*b* are respectively formed on the front film 1*a* and the back film 1*b* as an edge of the weakened part or the reinforced part.

An end (start end) 16*a* closer to the left side sealed part 2 of the front unsealing guide line 16 and an end (start end) 17*a* closer to the left side sealed part 2 of the back unsealing line 17 arranged at positions different from each other. On the other hand, an end (terminal end) 16*b* closer to the right side sealed part 4 of the front unsealing guide line 16 and an end (terminal end) 17*b* closer to the right side sealed part 4 of the back unsealing guide line 17 are superimposed on the point P3 on the inner edge 4*a* of the right side sealed part 4.

Figure 14:
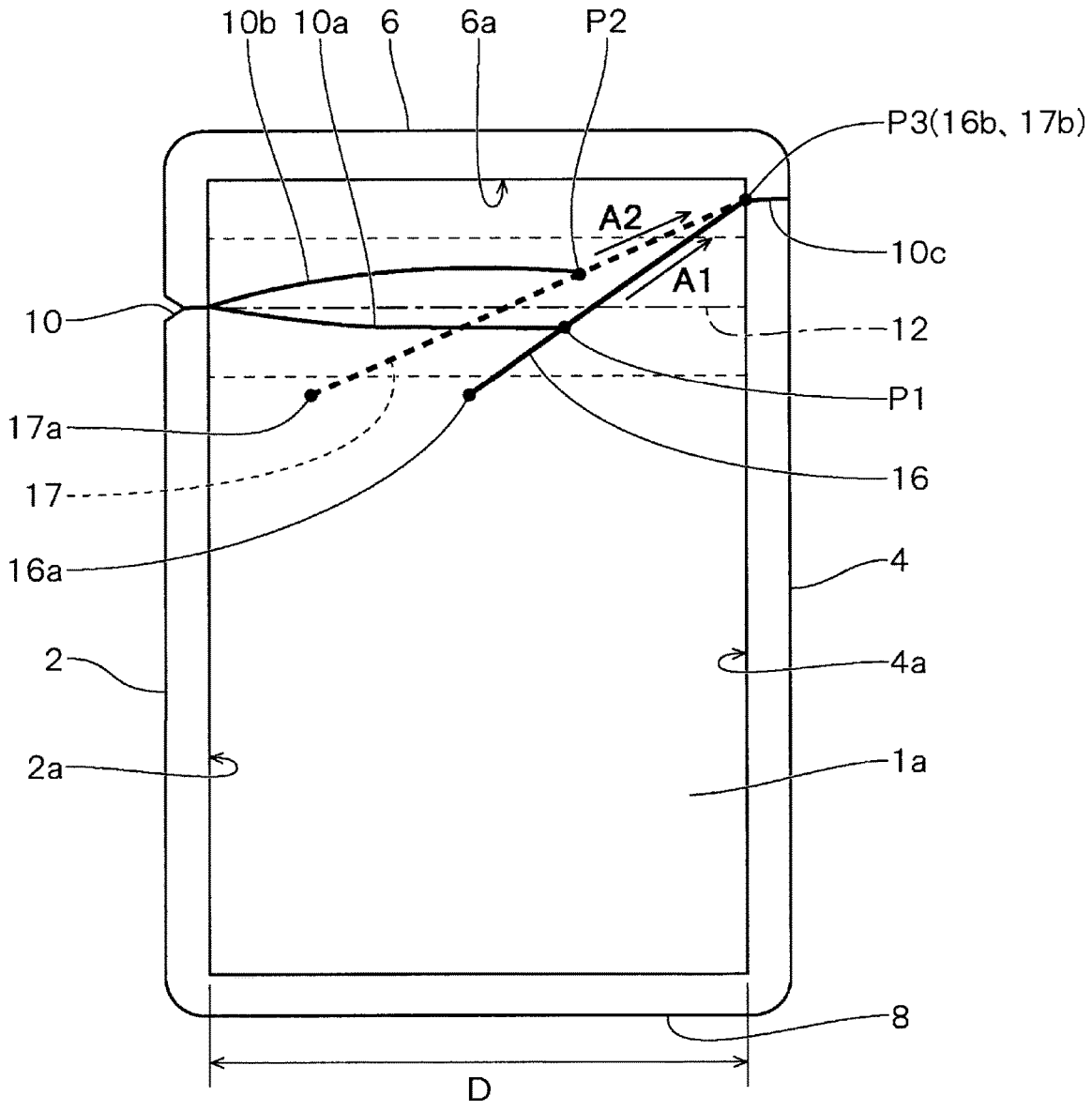
FIG. 14 shows a plan view for explaining the guide of the break line by the unsealing guide line at the time of unsealing in the modification example of the packaging bag according to the second embodiment.

Subsequently, with reference to FIG. 14, unsealing of the packaging beg of the present modification example will be explained. FIG. 14 shows the positions of the front break line 10*a* and the back break line 10*b* in a manner that they are overlapped on the packaging bag in the sealed state.

At the time of unsealing, the front break line 10*a* and the back break line 10*b* extend from the left side sealed part 2 to the right side sealed part 4. As a result, the front break line 10*a* arrives at the point P1 on the front unsealing guide line 16, and along the front unsealing guide line 16, it progresses in a direction indicated by an arrow A1 in FIG. 14. On the other hand, the back break line 10*b* arrives at the point P2 on the back unsealing guide line 17, and along the back unsealing guide line 17, it progresses in a direction indicated by an arrow A2 in FIG. 14.

The terminal end 16*b* of the front unsealing guide line 16 and the terminal end 17*b* of the back unsealing guide line 17 are arranged on the same point P3 on the inner edge 4*a* on the right side sealed part 4. Therefore, the front break line 10*a* and the back break line 10*b* are joined at the point P3. As a result, the right side sealed part 4 can be tom off with a small shear strength, and from the point P3, one break line 10*c* progresses on the right side sealed part 4, whereby a broken piece can be separated easily.

Third Embodiment

Subsequently, with reference to FIG. 15, the packaging bag according to the third embodiment will be explained.

As for the packaging bag of each of the following embodiments, the configuration is the same as that of the second embodiment except for the unsealing guide line. Therefore, the same constituent elements are indicated by the same numerical references, and a detailed explanation therefor is omitted. Further, in each of the following embodiments, as in the case of the second embodiment and its modification example, the unsealing guide line may be formed as a weakened part or as an edge of a reinforced part. Further, the front film and the back film may be arranged on different positions. Further, in each of the following embodiments, a preferable range of the angle formed by the unsealing guide line and the unsealing virtual straight line 12 is the same as that in the second embodiment. In each of the following embodiments, the end closer to the left side sealed part 2 of the unsealing guide line is referred to as the start end and the end closer to the right side sealed part 4 is referred to as the terminal end.

Figure 15:
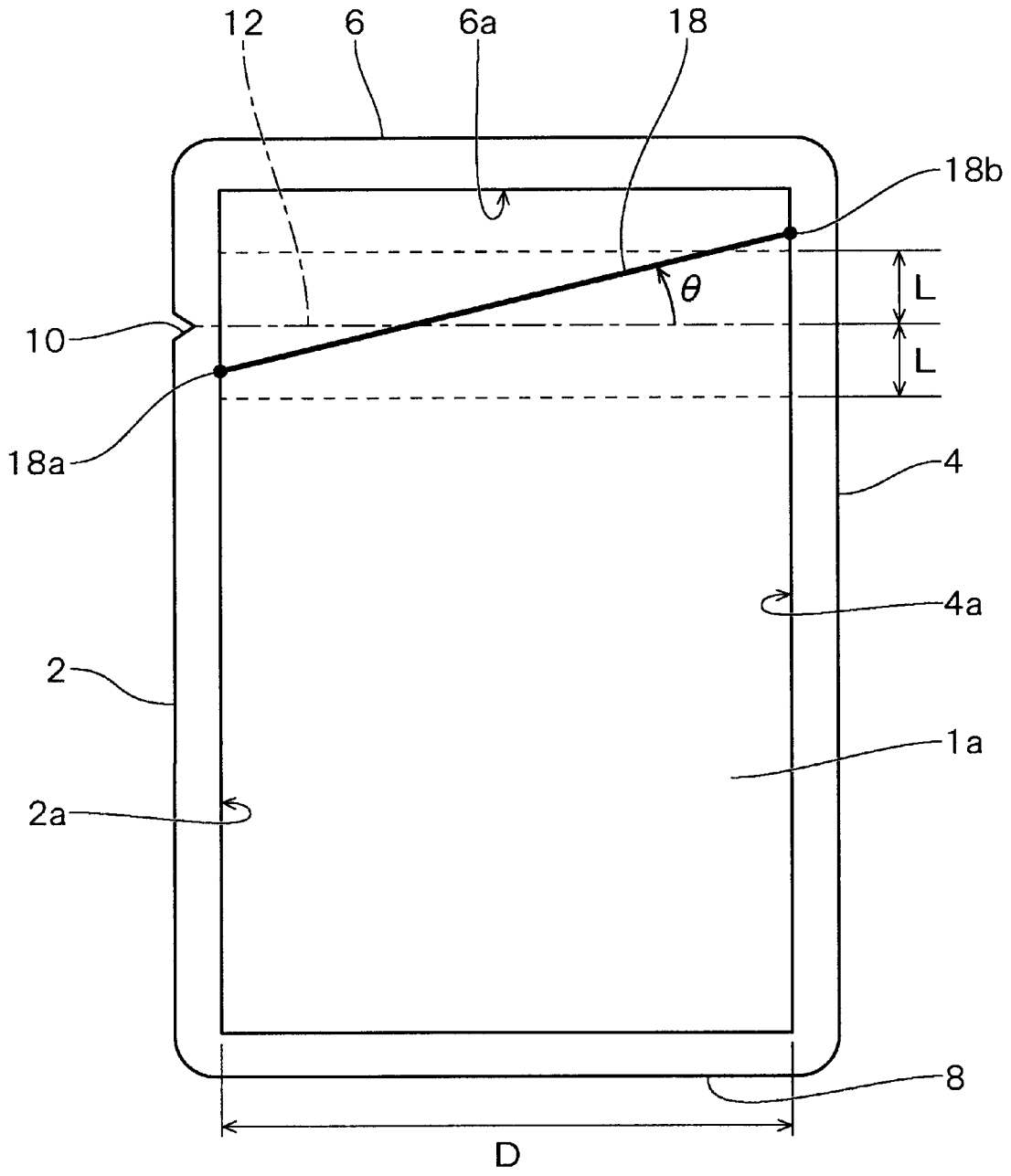
FIG. 15 shows a plan view of the packaging bag according to a third embodiment of the present invention.

As shown in FIG. 15, the front unsealing guide line and the back unsealing guide line 18 in the packaging bag in the present embodiment obliquely cross the unsealing virtual straight line 12, and extend in a direction from the lower left to the upper right. As in the case of the second embodiment, terminal ends 18*b* of the front unsealing guide line and the back unsealing guide line 18 are superimposed on the inner edge 4*a* of the right side sealed part 4 at a position that is remote for a distance L or longer from the unsealing virtual straight line 12. As a result, it is possible to increase the possibility that the break line arrives at the front unsealing guide line and the back unsealing guide line 14.

A start end 18*a* of each of the front unsealing guide line and the back unsealing guide line 18 is arranged on the inner edge 2*a* on the left side sealed part 2. As a result, the break line that progresses below the unsealing virtual straight line 12 arrives at the unsealing guide line 18 without fail.

At the time of unsealing, the front break line and the back break line respectively arrive at the front unsealing guide line and the back unsealing guide line 18 and are joined, and then arrive at the terminal end 18*b* on the inner edge 4*a* on the right side sealed part 4. As a result in the present embodiment, the right side sealed part 4 can be tom with a small shear force, and one break line progresses from the terminal end 18*b* on the right side sealed part 4, whereby a broken piece can be separated easily.

Fourth Embodiment

Subsequently, the packaging bag of the fourth embodiment will be explained with reference to FIG. 16.

The easily-openable part 10 of the packaging bag of the present embodiment is provided at a position closer to the top sealed part 6 as compared with one in the second embodiment.

Figure 16:
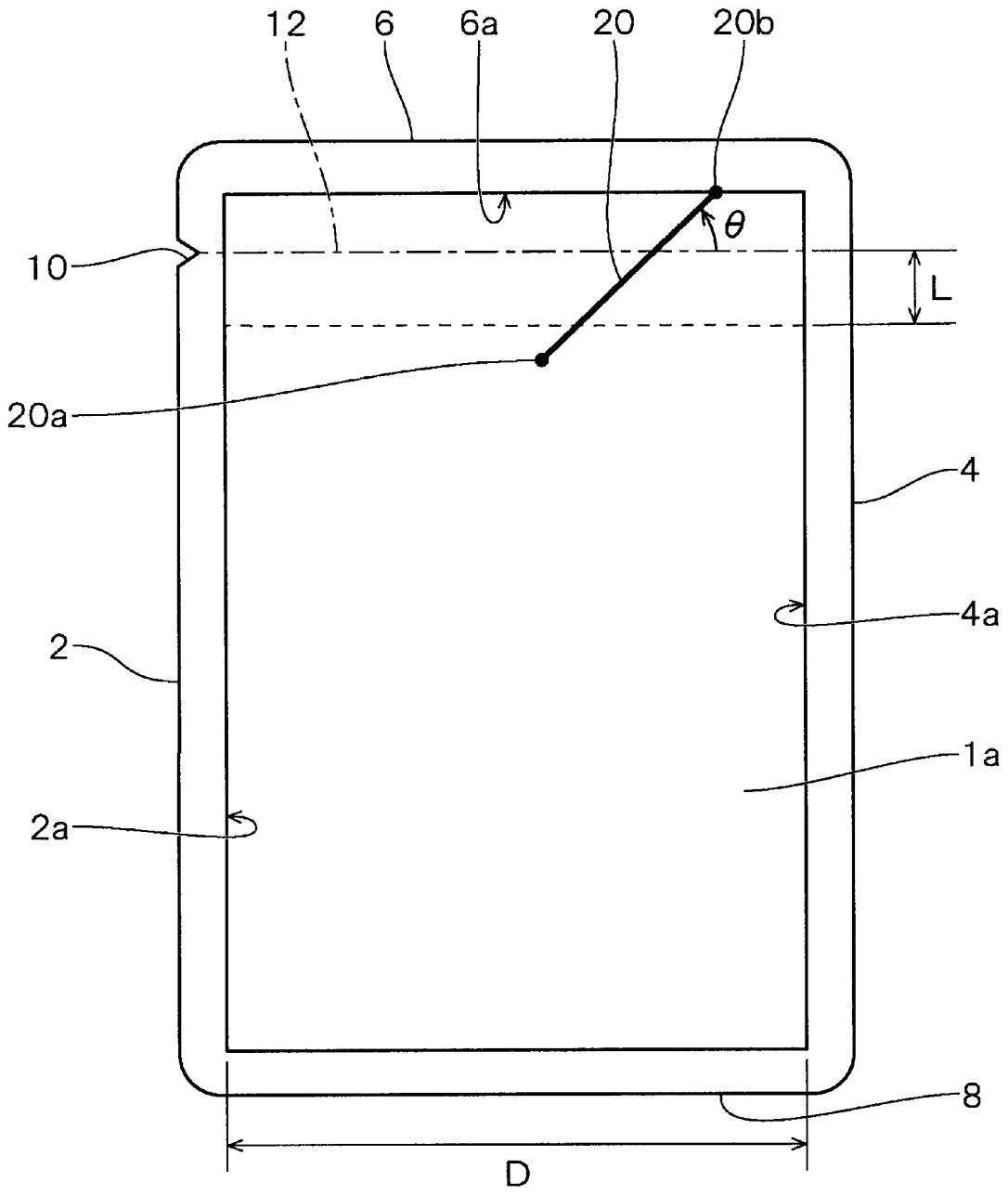
FIG. 16 shows a plan view of the packaging bag according to a fourth embodiment of the present invention.

As shown in FIG. 16, the front unsealing line and the back unsealing line 20 in the packaging bag in the present embodiment cross obliquely the unsealing virtual straight line 12, and extend in a direction from the lower left to the upper right. As in the case of the second embodiment, the start end 20*a* of each of the front unsealing guide line and the back unsealing guide line 20 is positioned below the unsealing virtual straight line 12 for a distance L or longer. As a result, the possibility that the break line arrives at the unsealing guide line 20 at the time of unsealing can be increased.

On the other hand, terminal ends 20*b* of the front unsealing guide line and the back unsealing guide line 20 are arranged in a superimposed manner on a lower edge 6*a* of the top sealed part 6. As a result, the break line that progresses above the unsealing virtual straight line 12 arrives at the unsealing guide line 20 without fail.

Figure 17:
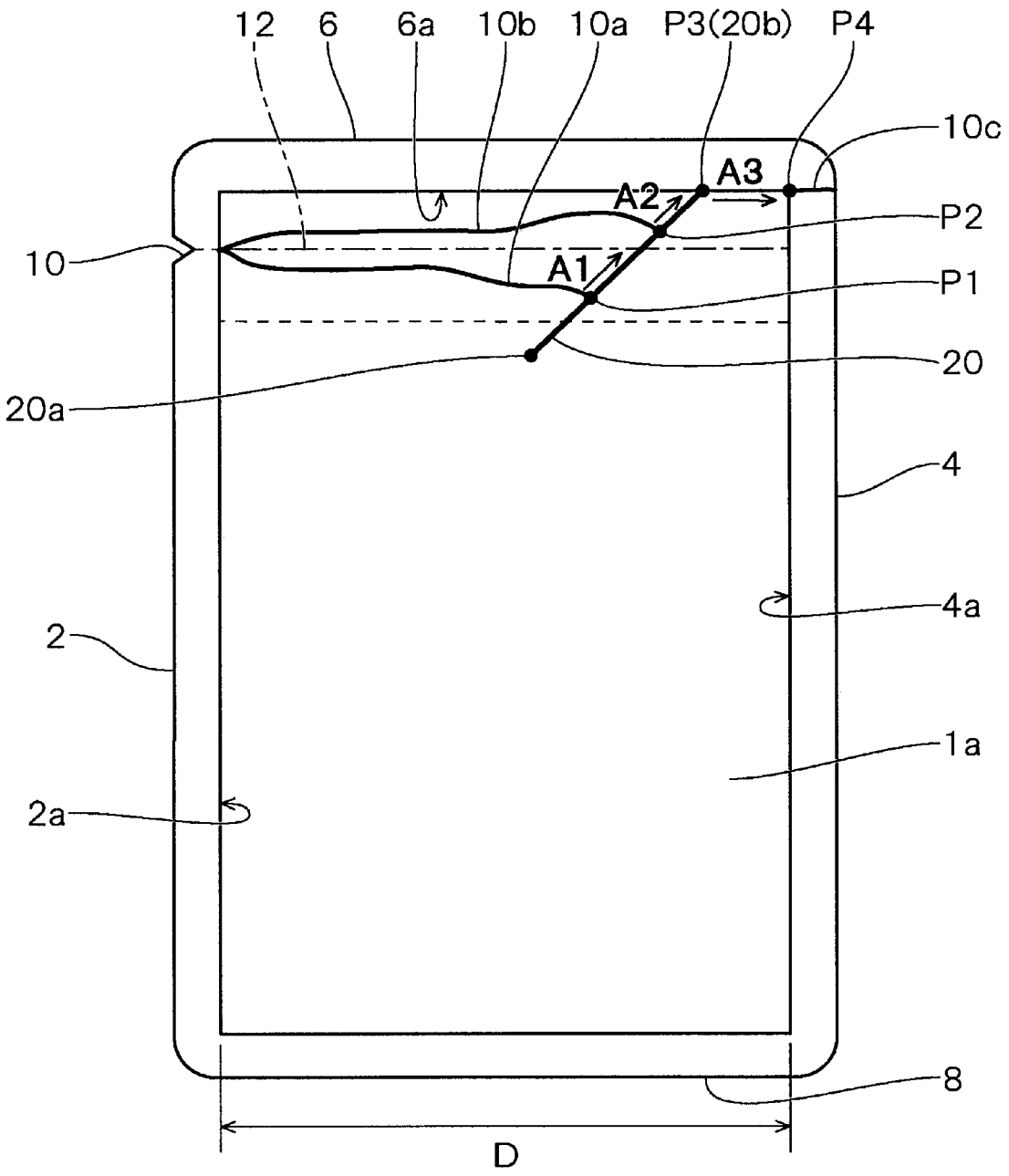
FIG. 17 shows a plan view for explaining the guide of the break line by the unsealing guide line at the time of unsealing in the packaging bag according to the fourth embodiment of the present invention.

Subsequently, with reference to FIG. 17, the unsealing of the packaging bag of the present embodiment will be explained. In FIG. 17, the positions of the front break line 10*a* and the back break line 10*b* are shown in a manner that they are overlapped on the packaging bag in the sealed state.

At the time of unsealing, the front break line 10*a* and the back break line 10*b* extend from the left side sealed part 2 to the right side sealed part 4. As a result, in the present embodiment, the front break line 10*a* arrives at the point P1 on the front unsealing line 20, and progresses in a direction indicated by an arrow A1 along the front unsealing guide line 20.

Subsequently, the back break line 10*b* arrives at the point P2 on the back unsealing guide line 20, and is joined with the front break line 10*a* that progresses along the front unsealing guide line 20. The front break line 10*a* and the back break line 10*b* that are joined at the point P2 progress along the front unsealing guide line and the back unsealing guide line 20 in a direction indicated by an arrow A2. As a result, both the front break line 10*a* and the back break line 10*b* are induced by the front unsealing guide line and the back unsealing guide line 20 to the terminal end 20*b* of the front unsealing guide line and the back unsealing guide line 20, i.e. the point P3 on the lower edge 6*a* on the top sealed part 6.

Both the front break line 10*a* and the back break line 10*b* that arrive at the point P3 progress in a direction indicated by an arrow A3 along the lower edge 6*a* of the top sealed part 6, and arrive at the point P4 at the corner at which the lower edge 6*a* of the top sealed part 6 and the inner edge 4*a* of the right side sealed part 4. Therefore, in the present embodiment, by the front unsealing guide line and the back unsealing guide line 20, the front break line 10*a* and the back break line 10*b* are induced to the same point on the inner edge 4*a* on the right side sealed part 4. As a result in the present embodiment, the right side sealed part 4 can be tom with a small shear force, and one break line 10*c* progresses from the point P4 on the right side sealed part 4, whereby the broken piece can be separated easily.

Meanwhile, the terminal end 20*b* may not be necessarily positioned on the lower edge 6*a* of the top sealed part 6, and may be positioned in a vicinity of the lower edge 6*a* of the top sealed part 6, as long as both the front break line 10*a* and the back break line 10*b* progress along the lower edge 6*a* of the top sealed part 6, and can be substantially induced to the same point of the inner edge 4*a* of the right side sealed part 4. Here, it is preferred that the terminal end 20*b* be positioned in the vicinity of the lower edge 6*a* within a distance of 10 mm or shorter from the lower edge 6*a*. The same can be applied to other embodiments.

Fifth Embodiment

Subsequently, with reference to FIG. 18, the packaging bag of the fifth embodiment will be explained.

The easy-openable part 10 of the packaging bag of the present embodiment is provided at a position closer to the top sealed part 6 as compared with one in the second embodiment.

Figure 18:
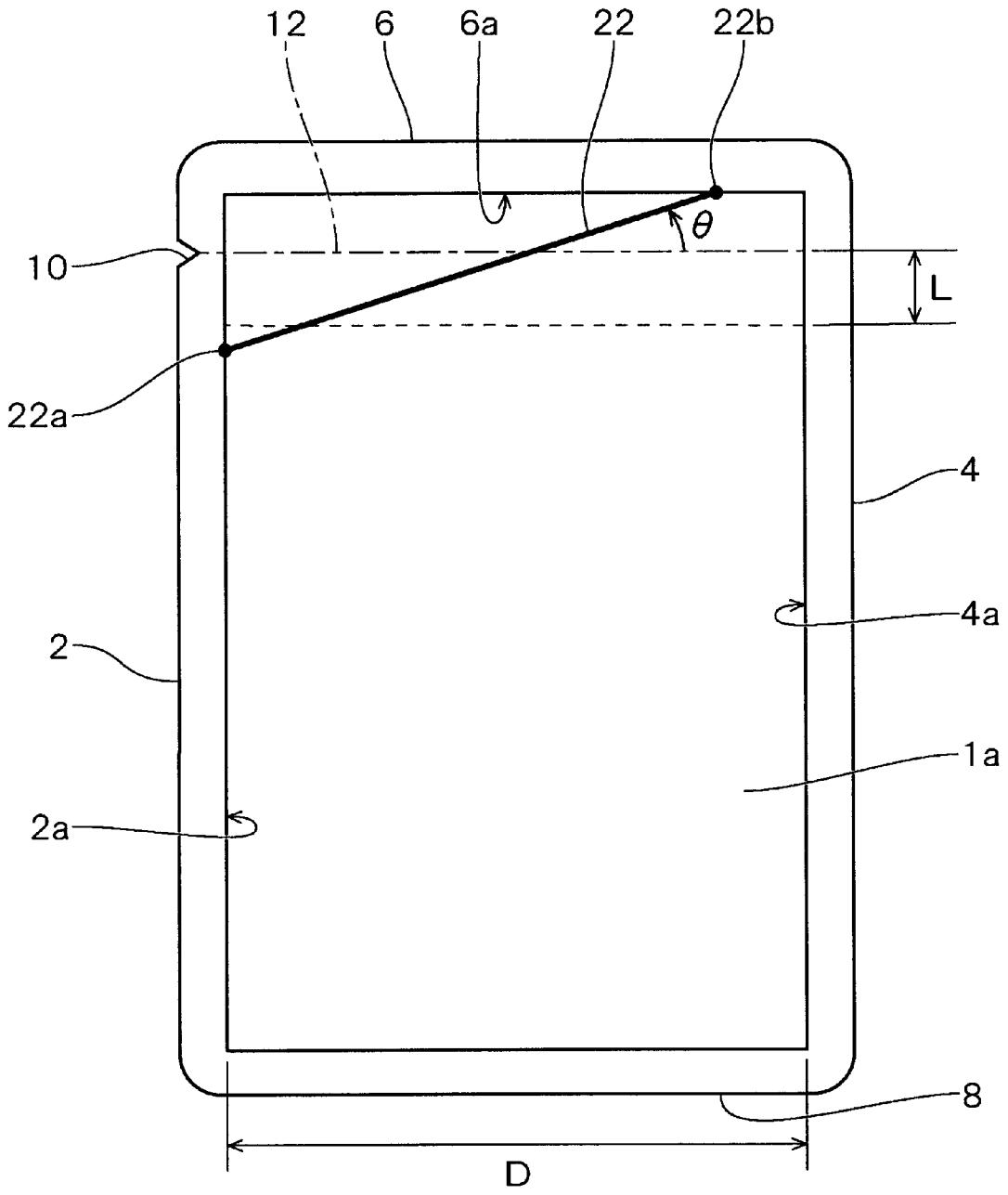
FIG. 18 shows a plan view of the packaging beg according to a fifth embodiment of the present invention.

As shown in FIG. 18, the front unsealing guide line and the back unsealing guide line 22 in the present embodiment obliquely cross the unsealing virtual straight line 12 and extend in a direction from the lower left to the upper right. The terminal end 22*b* of each of the front unsealing guide line and the back unsealing guide line 22 is positioned on the lower edge 6*a* of the top sealed part 6 as in the case of the fourth embodiment. As a result, the break line that progresses above the unsealing virtual straight line 12 arrives at the front unsealing guide line and the back unsealing guide line 22 without fail.

Start ends 22*a* of the front unsealing guide line and the back unsealing guide line 22 are positioned on the inner edge 2*a* of the left side sealed part 2. As a result, at the time of unsealing, a break line that progresses below the unsealing virtual straight line 12 arrives at the front unsealing guide line and the back unsealing guide line 22 without fail. Therefore, in this embodiment, when unsealing, the front break line and the back break line respectively arrive at the front unsealing guide line and the back unsealing back line 22 without fail.

At the time of unsealing, the front break line and the back break line respectively arrive at the front unsealing guide line and the back unsealing guide line 22 and are joined, and arrive at the terminal ends 22*b* that are superimposed on the lower edge 6*a* of the top sealed part 6. Both the front break line and the back break line that arrive at the terminal end 22*b* progress along the lower edge 6*a* of the top sealed part 6, and arrive at a corner where the lower edge 6*a* of the top sealed part 6 and the lower edge 4*a* of the right side sealed part 4 are joined. As a result, in the present embodiment, the right side sealed part 4 can be tom off with a small shear force, and one break line progresses the right side sealed part 4 from the corner, whereby the broken piece can be separated easily.

Sixth Embodiment

Figure 19:
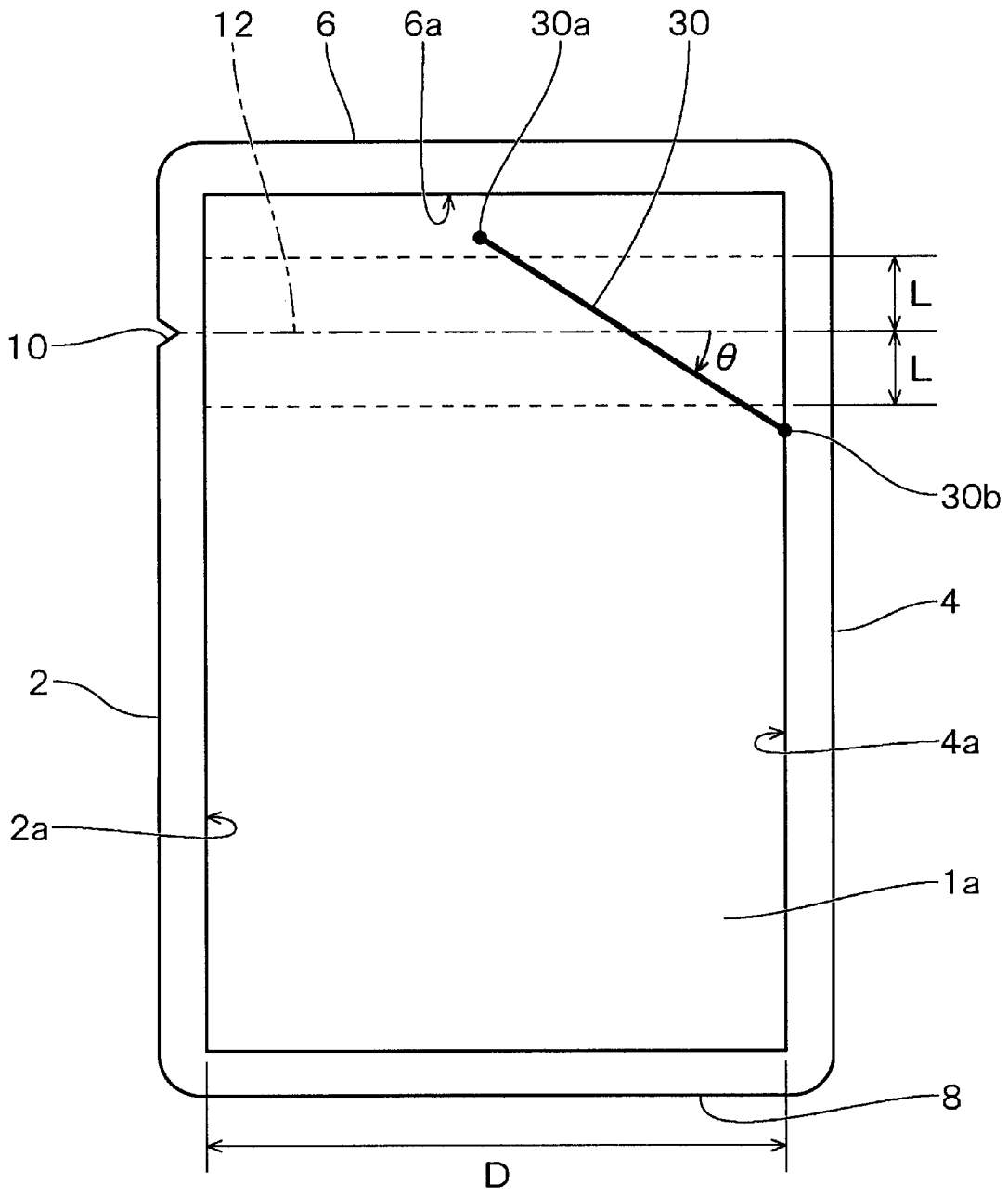
FIG. 19 shows a plan view of the packaging bag according to a sixth embodiment of the present invention.

Subsequently, with reference to FIG. 19, the packaging bag according to the sixth embodiment will be explained. As shown in FIG. 19, the front unsealing guide line and the back unsealing guide line 30 in the packaging bag in the present embodiment cross obliquely the unsealing virtual straight line 12 and extend in a direction from the upper left to the lower right. Terminal ends 30*b* of the front unsealing guide line and the back unsealing guide line 30 are superimposed on the inner edge 4*a* of the right side sealed part 4 at a position below for a distance L or longer from the unsealing virtual straight line 12. As a result, the possibility that the break line that progresses below the unsealing virtual straight line 12 arrives at the unsealing guide line 30 at the time of unsealing can be increased.

In the meantime, in order to prevent leakage of the contents of the packaging bag at the time of unsealing, it is preferred that terminal ends 30*b* of the front unsealing guide line and the back unsealing guide line 30 be positioned at a position higher than the upper surface of the contents. In general, in a packaging bag such as a retort pouch, in many cases, in a state that the top sealed part 6 of the retort pouch with being upward, the upper surface of the contents is positioned below the unsealing guide line 12 and at a position below the unsealing virtual straight line 12 for a distance of 23% or shorter of the length D from the unsealing virtual straight line 12 along the unsealing virtual straight line 12 of the inner edges 2*a* and 4*a* of a pair of side sealed parts 2 and 4. Therefore, in the present embodiment, when the upper surface of the contents is positioned at a position remote downwardly for a predetermined distance L from the unsealing virtual straight line 12, it is preferred that the terminal ends 30*b* closer to the right side sealed part 4 of the front unsealing guide line and the back sealing guide line 30 be positioned at a position below the unsealing virtual straight line 12 and is remote for a distance of 23% or shorter of the length D from the unsealing virtual straight line 12.

On the other hand, the start end 30*a* of the unsealing guide line 30 is positioned at a position above the unsealing virtual straight line 12 and is remote for a prescribed distance L or longer. As a result, it is possible to increase the possibility that the break line that progresses above the unsealing virtual straight line 12 arrives at the unsealing guide line 30.

At the time of unsealing, the front break line and the back break line respectively arrive at the front unsealing guide line and the back unsealing guide line 30 and are joined, and arrive at the end terminals 30*b* that are superimposed on the inner edge 4*a* of the right side sealed part 4. As a result, in the present embodiment, the right side sealed part 4 can be tom off with a small shear strength, and one break line from the terminal end 30*b* of the front unsealing guide line and the back unsealing guide line 30 progresses on the right side sealed part 4, whereby a broken piece can be separated easily.

Seventh Embodiment

Subsequently, with reference to FIG. 20, the packaging bag according to the seventh embodiment will be explained.

The easy-openable part 10 of the packaging bag of the present embodiment is provided at a position closer to the top sealed part 6 as compared with one in the second embodiment.

Figure 20:
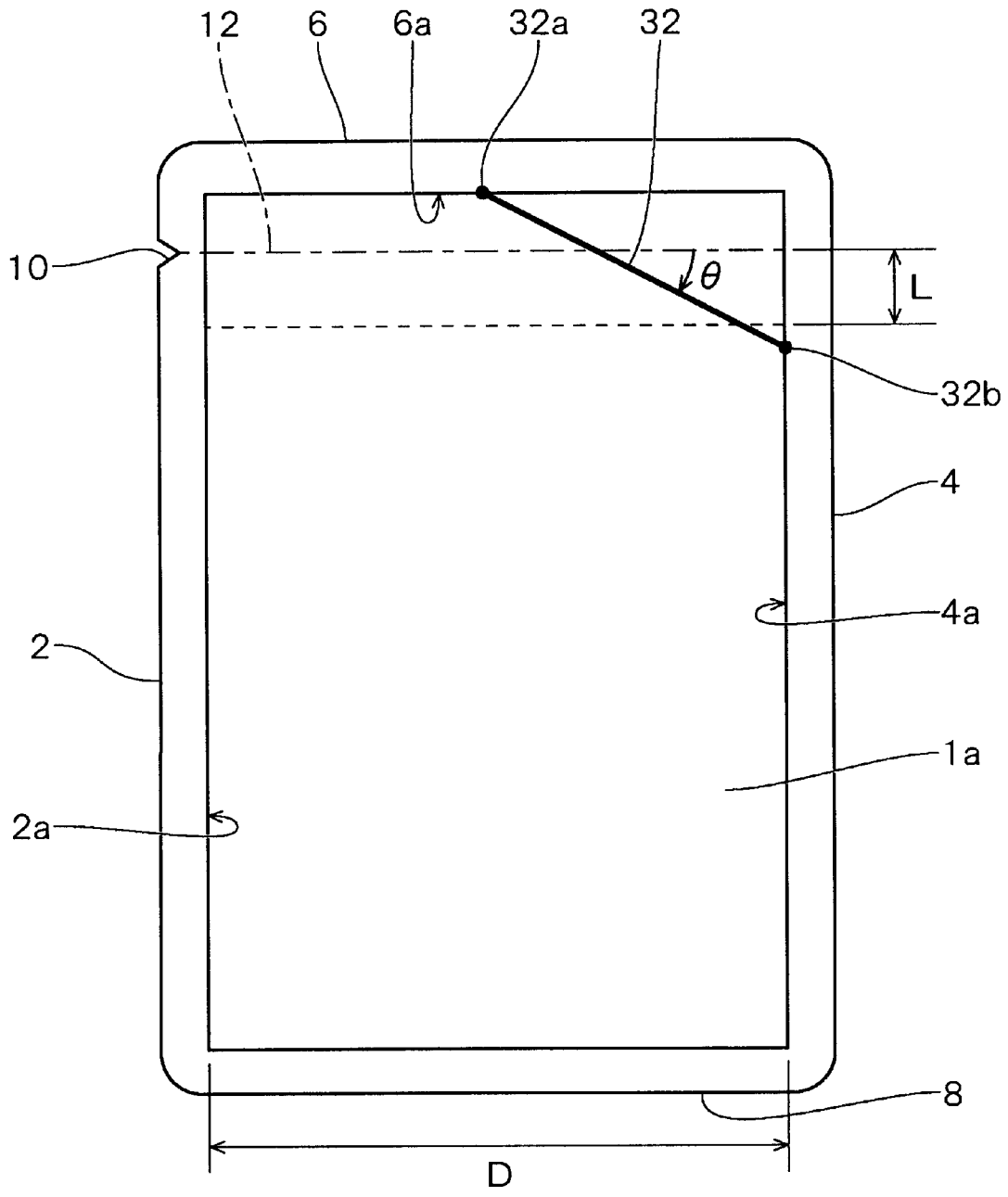
FIG. 20 shows a plan view of the packaging bag according to a seventh embodiment of the present invention.

As shown in FIG. 20, the front unsealing guide line and the back unsealing guide line 32 in the packaging bag in the present embodiment obliquely cross the unsealing virtual straight line 12, and extend in a direction from the upper left to the lower right. As in the case of the sixth embodiment, terminal ends 32*b* of the front unsealing guide line and the back unsealing guide line 32 are superimposed on the inner edge 4*a* on the right side sealed part 4 at a position remote downwardly for a distance L or longer from the unsealing virtual straight line 12. As a result, the possibility that the break line that progresses below the unsealing virtual straight line 12 arrives at the front unsealing guide line and the back unsealing guide line 32 at the time of unsealing can be increased.

On the other hand, start ends 32*a* of the front unsealing guide line and the back unsealing guide line 32 are positioned on the lower edge 6*a* of the top sealed part 6. As a result, the break line that progresses above the unsealing virtual straight line 12 can arrive at the front unsealing guide line and the back unsealing guide line 32 without fail.

At the time of unsealing, the front break line and the back break line respectively arrive at the front unsealing guide line and the back unsealing guide line 32 and are joined, and arrive at the terminal end 32*b* on the inner edge 4*a* on the right side sealed part 4. As a result, in the present embodiment, the right side sealed part 4 can be tom off with a small shear strength, and one break line from the terminal end 32*b* at which the front unsealing guide line and the back unsealing guide line 32 are superimposed progresses on the right side sealed part 4, whereby a broken piece can be separated easily.

Eighth Embodiment

Subsequently, the packaging bag according to the eighth embodiment will be explained with reference to FIG. 21.

Figure 21:
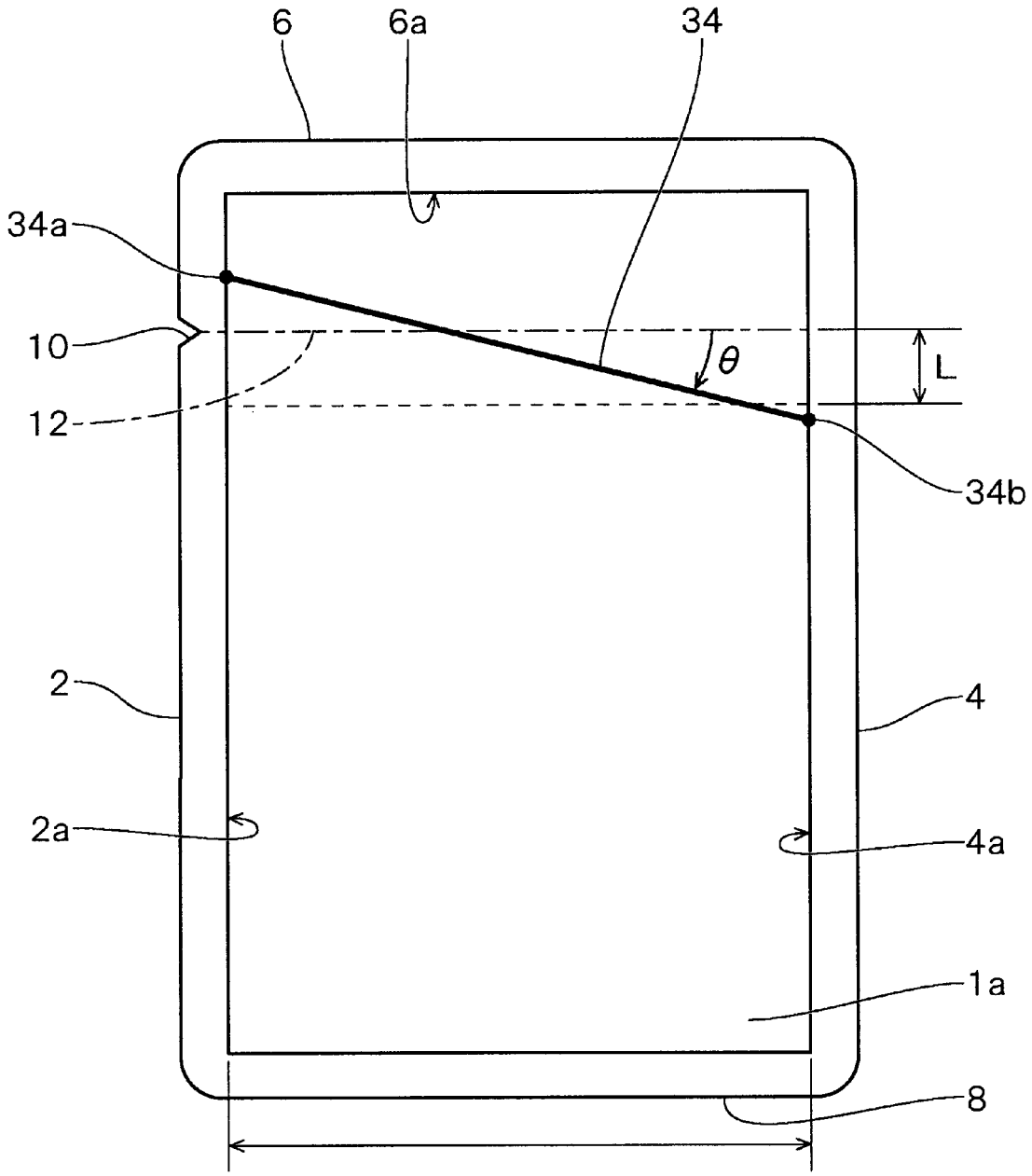
FIG. 21 shows a plan view of the packaging bag according to an eighth embodiment of the present invention.

As shown in FIG. 21, the front unsealing guide line and the back unsealing guide line 34 in the packaging bag in the present embodiment obliquely cross the unsealing virtual straight line 12, and extend in a direction from the upper left to the lower right. As in the case of the sixth embodiment, terminal ends 34*b* of the front unsealing guide line and the back unsealing guide line 34 are superimposed on the inner edge 4*a* on the right side sealed part 4 at a position remote downwardly for a distance L or longer from the unsealing virtual straight line 12. As a result, the possibility that the break line that progresses below the unsealing virtual straight line arrives at the unsealing guide line 34.

Start ends 34*a* of the front unsealing guide line and the back unsealing guide line 34 are positioned on the inner edge 2*a* on the left side sealed part 2. As a result, at the time of unsealing, the break line that progresses above the unsealing virtual straight line 12 can arrive at the unsealing guide line 34 without fail.

At the time of unsealing, the front break line and the back break line respectively arrive at the front unsealing guide line and the back unsealing guide line 34 and are joined, and arrive at the terminal ends 34*b* that are superimposed on the inner edge 4*a* of the right side sealed part 4. As a result, in the present embodiment, the right side sealed part 4 can be tom off with a small shear strength, and one break line from the terminal end 34*b* of the front unsealing guide line and the back unsealing guide line 34 progresses on the right side sealed part 4, whereby a broken piece can be separated easily.

Ninth Embodiment

Subsequently, the packaging bag according to the ninth embodiment will be explained with reference to FIG. 22.

Figure 22:
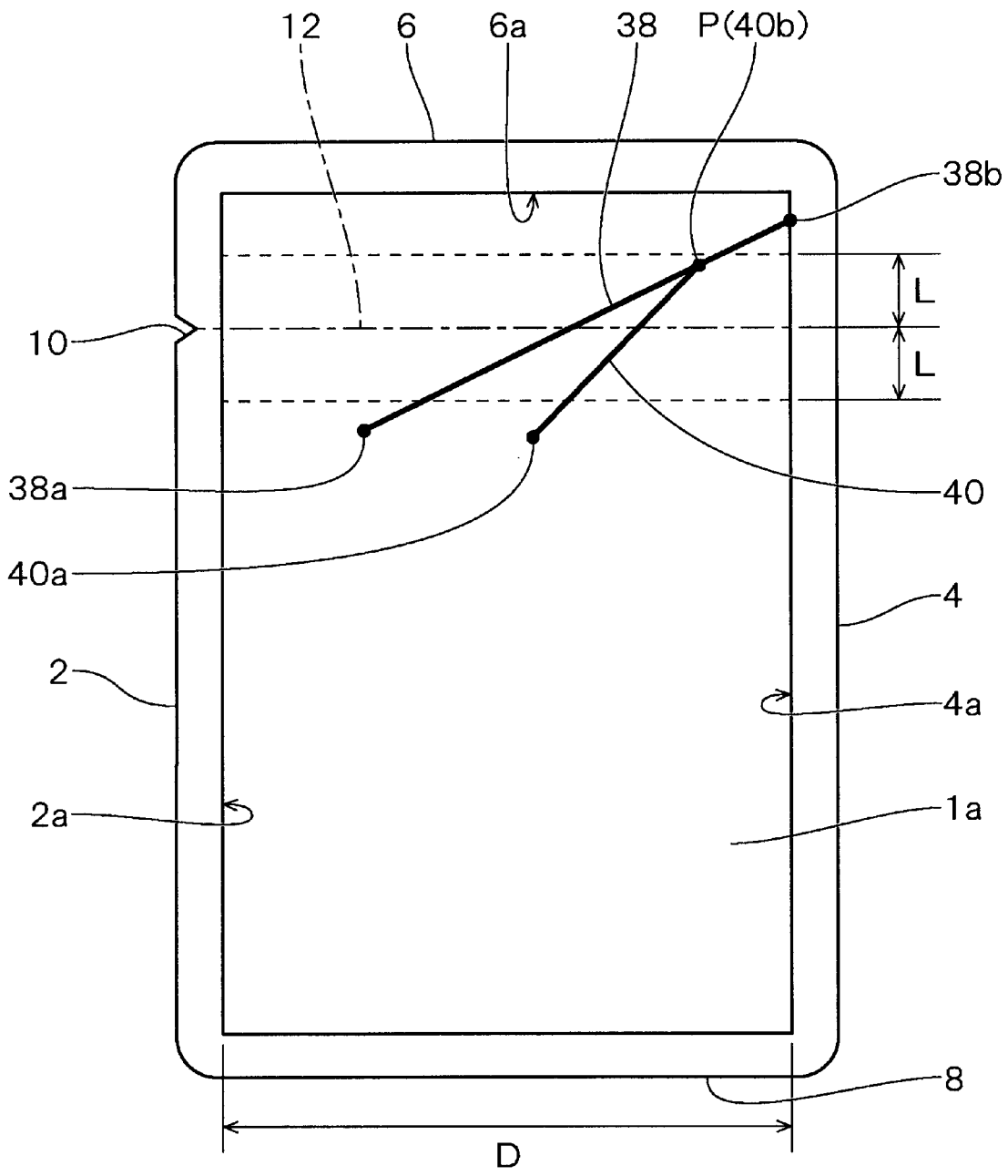
FIG. 22 shows a plan view of the packaging bag according to a ninth embodiment of the present invention.

As shown in FIG. 22, the unsealing guide line of the present embodiment is composed of a first unsealing guide line 38 and a second unsealing guide line 40 that is arranged closer to the other side sealed part 4 than the first unsealing guide line 38, which are formed on each of the front film 1*a* and the back film 1*b*. Both the first unsealing guide line 38 and the second unsealing guide line 40 obliquely cross the unsealing virtual straight line 12 and extend in a direction from the lower left to the upper right.

The start end 38*a* of a first unsealing guide line 38 is positioned below the unsealing virtual straight line 12 for a distance of L or longer. On the other hand, the terminal end 38*b* of the first unsealing guide line 38 is positioned on the inner edge 4*a* of the right side sealed part 4 above the unsealing virtual straight line 12 for a distance of L or longer.

The second unsealing guide line 40 is branched from the point P on the first unsealing guide line 38, and arranged such that it is remote from the first unsealing guide line 38 as it approaches the left side sealed part 2. A terminal end 40*b* of the second unsealing guide line 40 is arranged on the point P on the first unsealing guide line 38, and a terminal end 40*a* of the second unsealing guide line 40 is positioned below the unsealing virtual straight line 12 for a distance of L or longer.

As mentioned above, since the second unsealing guide line 40 is provided in addition to the first unsealing guide line 38, at the time of unsealing, if one or both of the front break line and the back break line that arrive at the first unsealing guide line 38 progress across the first unsealing guide line 38, it is possible to induce the break line that arrives at the second unsealing guide line 40 to the point P on the first unsealing guide line 38, and subsequently, it is possible to induce the break line(s) to the terminal end 38*b* on the inner edge 4*a* on the right side sealed part 4 by the first unsealing guide line 38.

Tenth Embodiment

Subsequently, the packaging bag according to the tenth embodiment will be explained with reference to FIG. 23.

Figure 23:
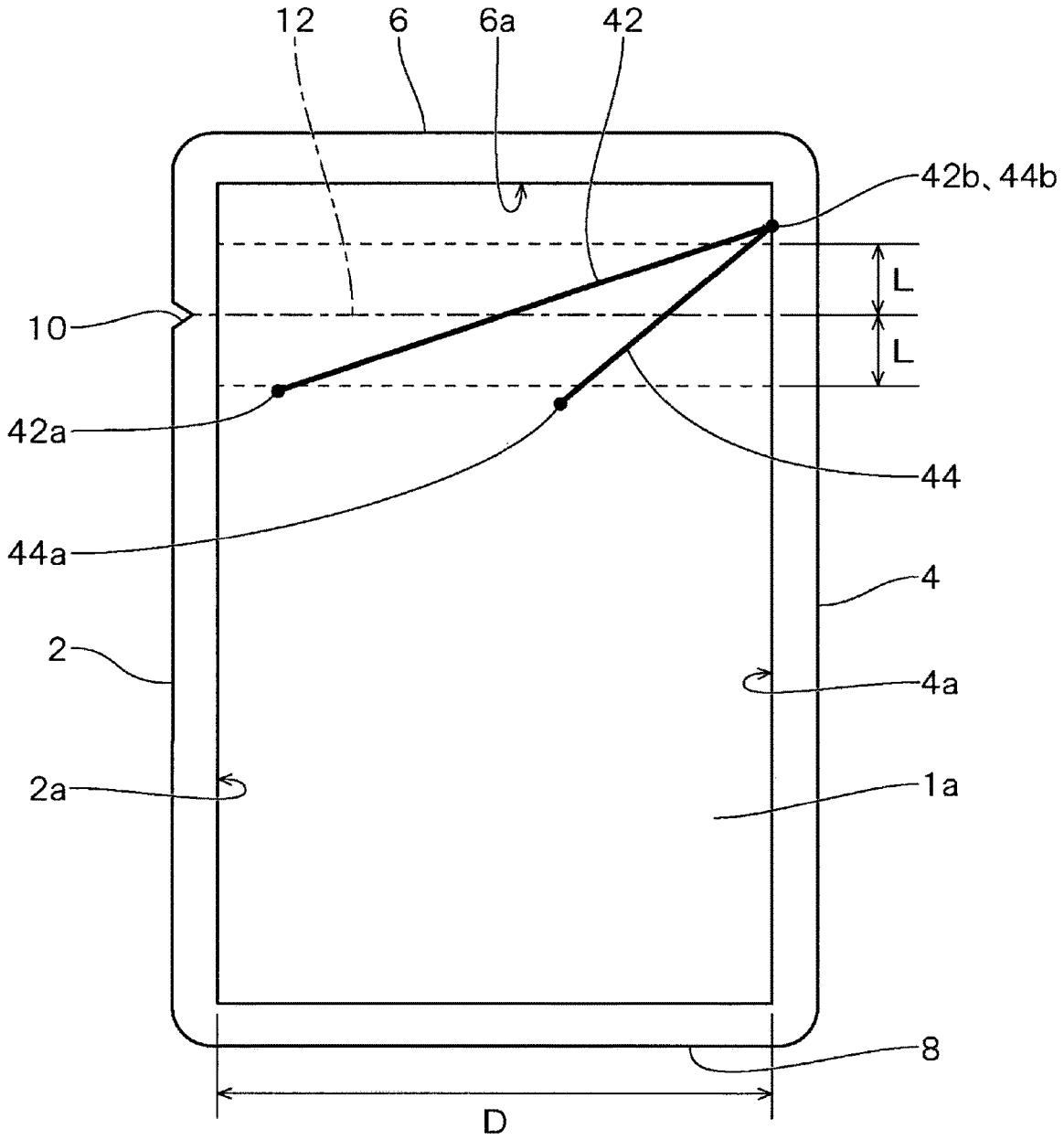
FIG. 23 shows a plan view of the packaging bag according to a tenth embodiment of the present invention.

As shown in FIG. 23, the unsealing guide line is composed of a first unsealing guide line 42 and a second unsealing guide line 44 that is arranged closer to the other side sealed part 4 than the first unsealing guide line 42, which are formed on each of the front film 1*a* and the back film 1*b*. Both the first unsealing guide line 42 and the second unsealing guide line 44 obliquely cross the unsealing virtual straight line 12 and extend in a direction from the lower left to the upper right, and are arranged such that they are remote from each other as they approach the left side sealed part 2.

A terminal end 42*b* of the first unsealing guide line 42 and a terminal end 44*b* of the second unsealing guide line 44 are arranged such that they are superimposed on the inner edge 4*a* of the right side sealed part 4 at a position that is remote upwardly from the unsealing virtual straight line 12 for a prescribed distance L or longer. In addition, the start end 42*a* of the first unsealing guide line 42 and the start end 44*a* of the second unsealing guide line 44 are arranged at a position that is below the unsealing virtual straight line 12 for a distance of L or longer.

As mentioned above, since the second unsealing guide line 44 is provided in addition to the first unsealing guide line 42, at the time of unsealing, if one or both of the front break line and the back break line that arrive at the first unsealing guide line 42 progress across the first unsealing guide line 42, it is possible to induce the break line that arrives at the second unsealing guide line 44 to the terminal end 44*b* on the inner edge 4*a* on the right side sealed part 4.

Eleventh Embodiment

Figure 24:
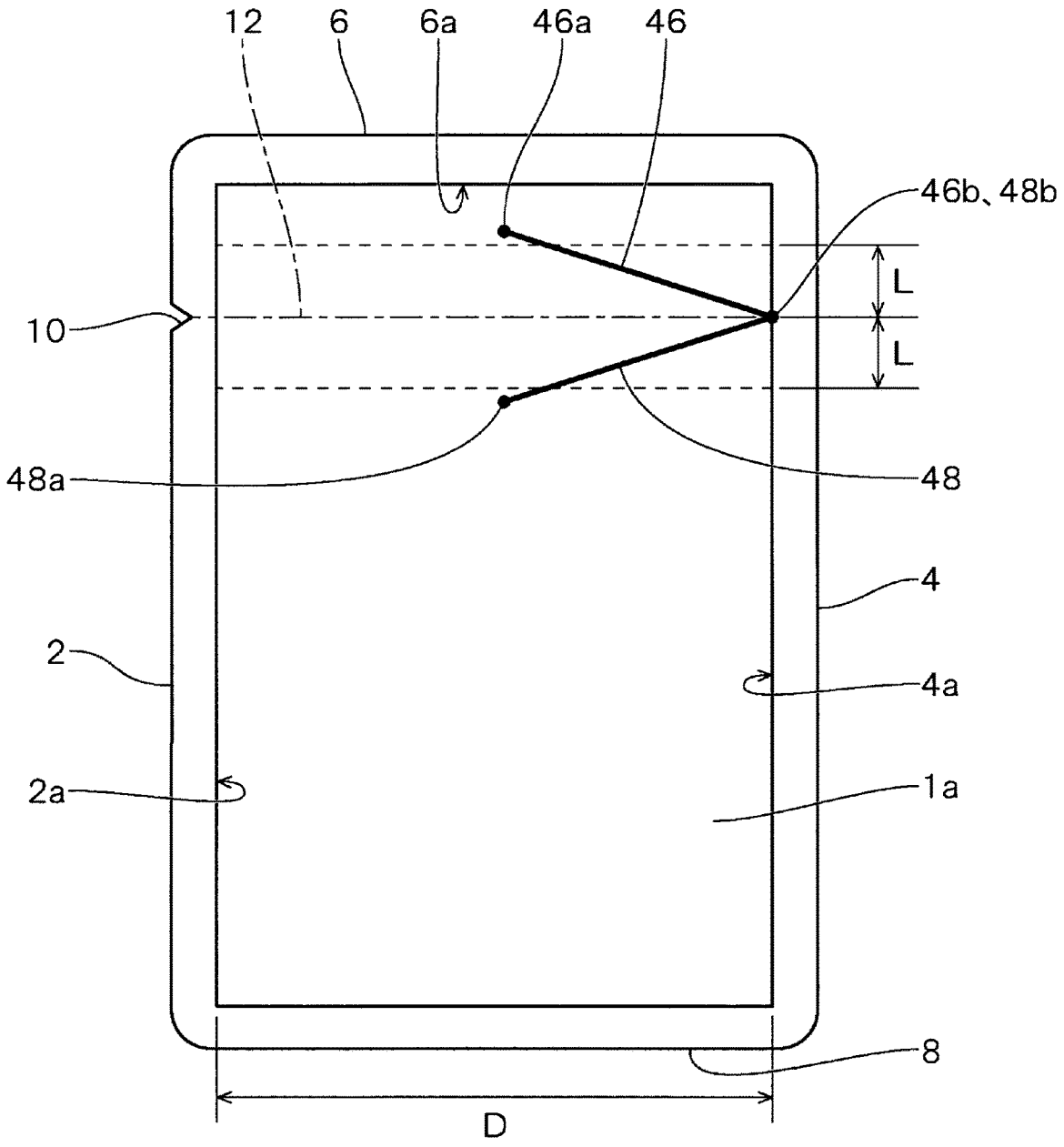
FIG. 24 shows a plan view of the packaging bag according to an eleventh embodiment of the present invention.

The packaging bag of the eleventh embodiment will be explained with reference to FIG. 24.

The unsealing guide line of the present embodiment is composed of a first unsealing guide line 46 and a second unsealing guide line 48 that are provided on each of the front film 1*a* and the back film 1*b*. The first unsealing guide line 46 and the second unsealing guide line 48 inclined oppositely relative to the unsealing virtual straight line 12 and is arranged such that they are remote from each other as they approach the left side sealed part 2.

A terminal end 46*b* of the first unsealing guide line 46 and a terminal end 48*b* of the second unsealing guide line 48 are arranged on the unsealing virtual straight line 12 on the inner edge 4*a* of the right side sealed part 4 in a manner that they are superimposed.

The terminal end 46*b* and the terminal end 48*b* may be arranged in a manner that they are superimposed on the inner edge 4*a* of the right side sealed part 4 at a position remote from the unsealing virtual straight line 12.

A start end 46*a* of the first unsealing guide line 46 is arranged above the unsealing virtual straight line 12 at a position remote for a prescribed distance L or longer. On the other hand, a start end 48*a* of the 35 second unsealing line 48 is arranged at a position below the unsealing virtual straight line 12 for a prescribed distance L or longer. As a result, it is possible to increase the possibility that the break line arrives at at least one of the first and second unsealing guide lines 46 and 48.

Figure 25:
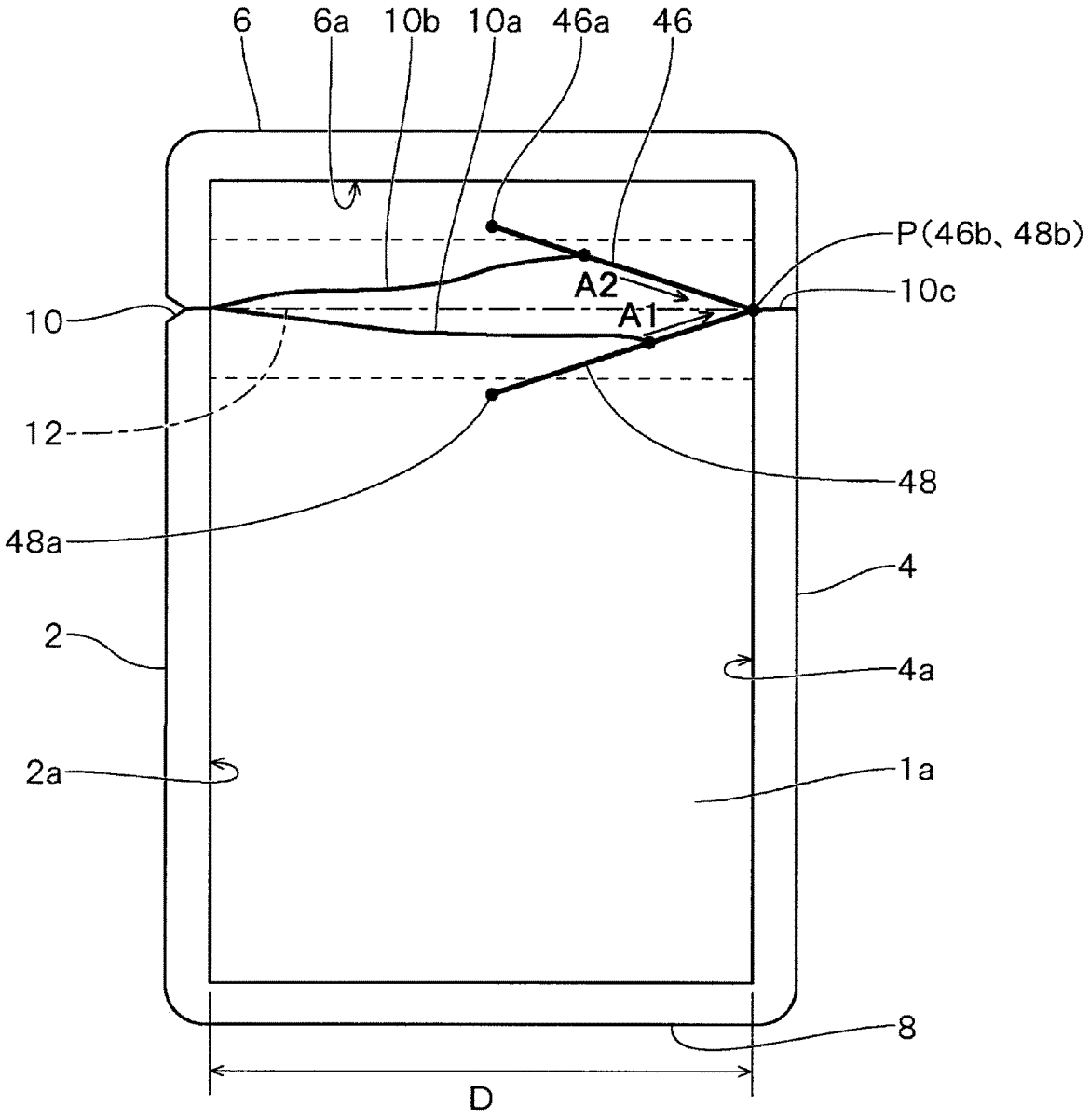
FIG. 25 shows a plan view for explaining guide of the break line by the unsealing guide line in the packaging bag according to the eleventh embodiment of the present invention.

Subsequently, with reference to FIG. 25, the unsealing of the packaging bag of the present embodiment will be explained. FIG. 25 shows the positions of the front break line 10*a* and the back break line 10*b* at the time of unsealing are shown in a manner that they are overlapped on the packaging bag in a sealed state.

At the time of unsealing, the front break line 10*a* and the back break line 10*b* extend from the left side sealed part 2 to the right side sealed part 4. As a result, the front break line 10*a* arrives at the second unsealing guide line 48 and progresses in a direction indicated by an arrow A1 along the second unsealing guide line 48, and arrives at the terminal end 48*b* of the second unsealing guide line 48. On the other hand, the back break line 10*b* arrives at the first unsealing guide line 46, progresses in a direction indicated by an arrow A2 along the first unsealing guide line 46, and arrives at the terminal end 46*b* of the first unsealing guide line 46.

Since both the terminal end 46*b* and the terminal end 48*b* are arranged in a superimposed manner on the point P on the inner edge 4*a* of the right side sealed part 4, the front break line 10*a* and the back break line 10*b* are joined at the point P. As a result, the right side sealed part 4 can be tom off with a small shear force, and one break line 10*c* progresses from the point P on the right side sealed part 4, whereby a broken piece can be separated easily.

The Twelfth Embodiment

Figure 26:
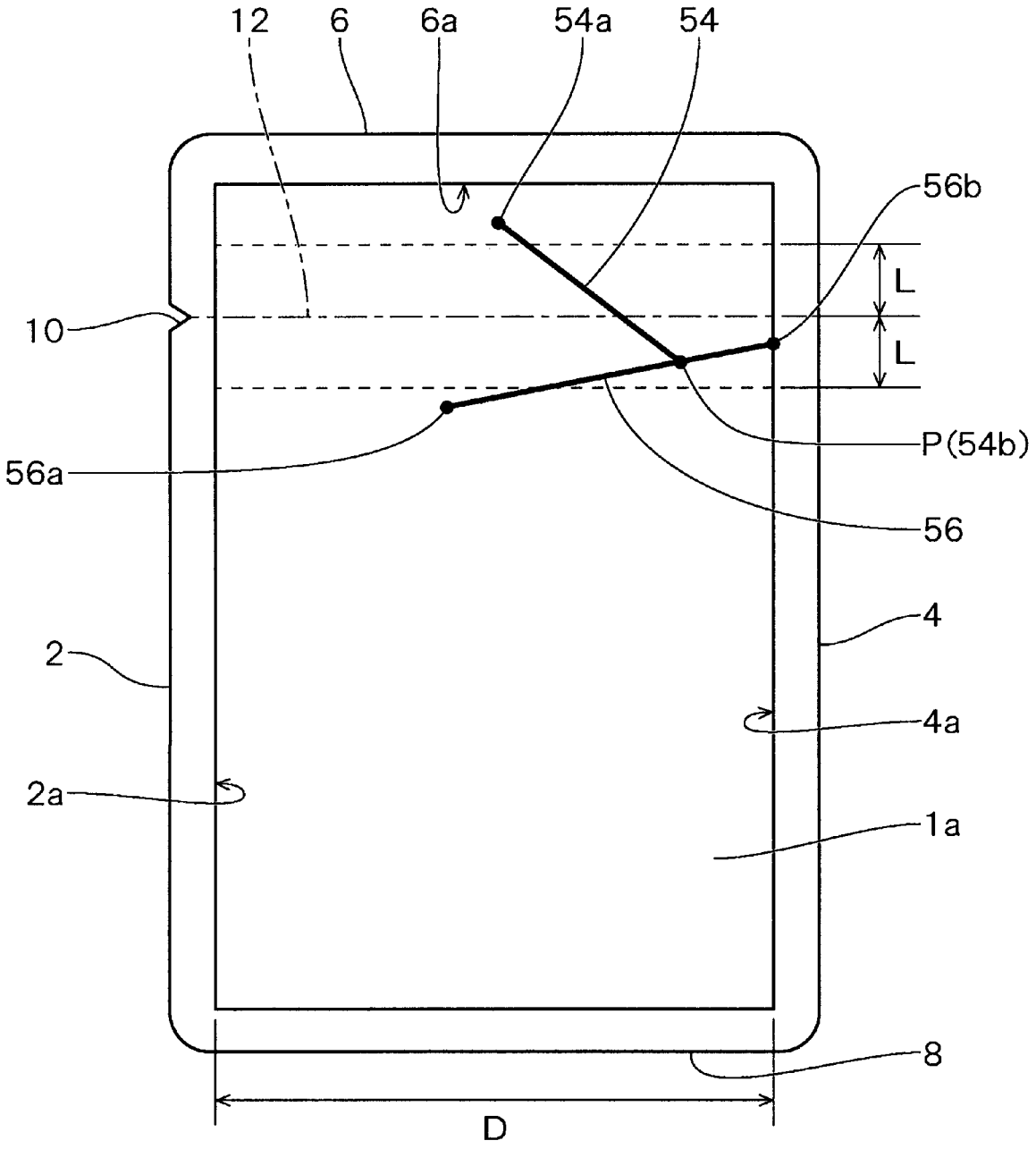
FIG. 26 shows a plan view of the packaging bag according to a twelfth embodiment of the present invention.
Figure 27:
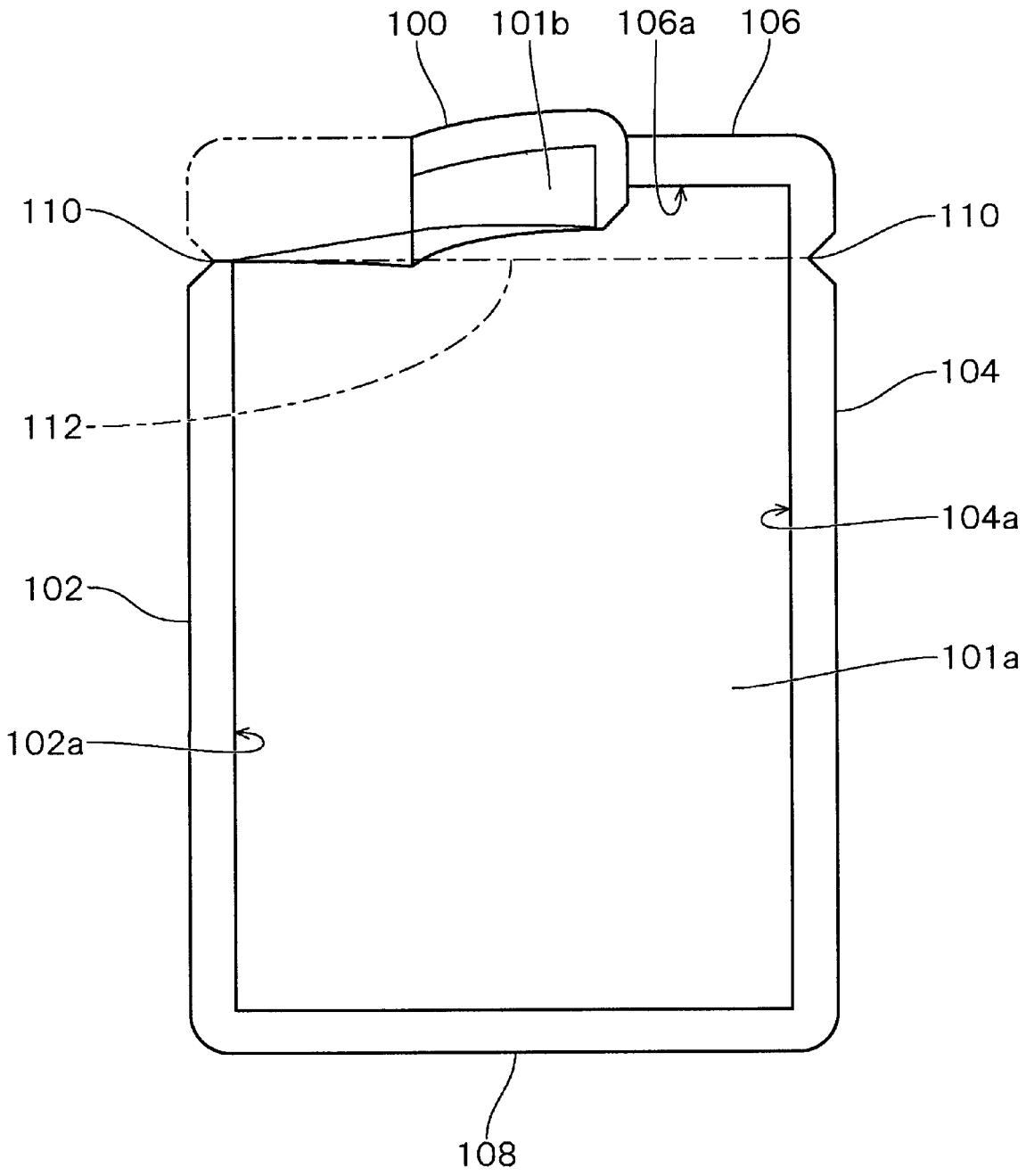
FIG. 27 shows a plan view showing a state of unsealing a conventional packaging bag.
Figure 28:
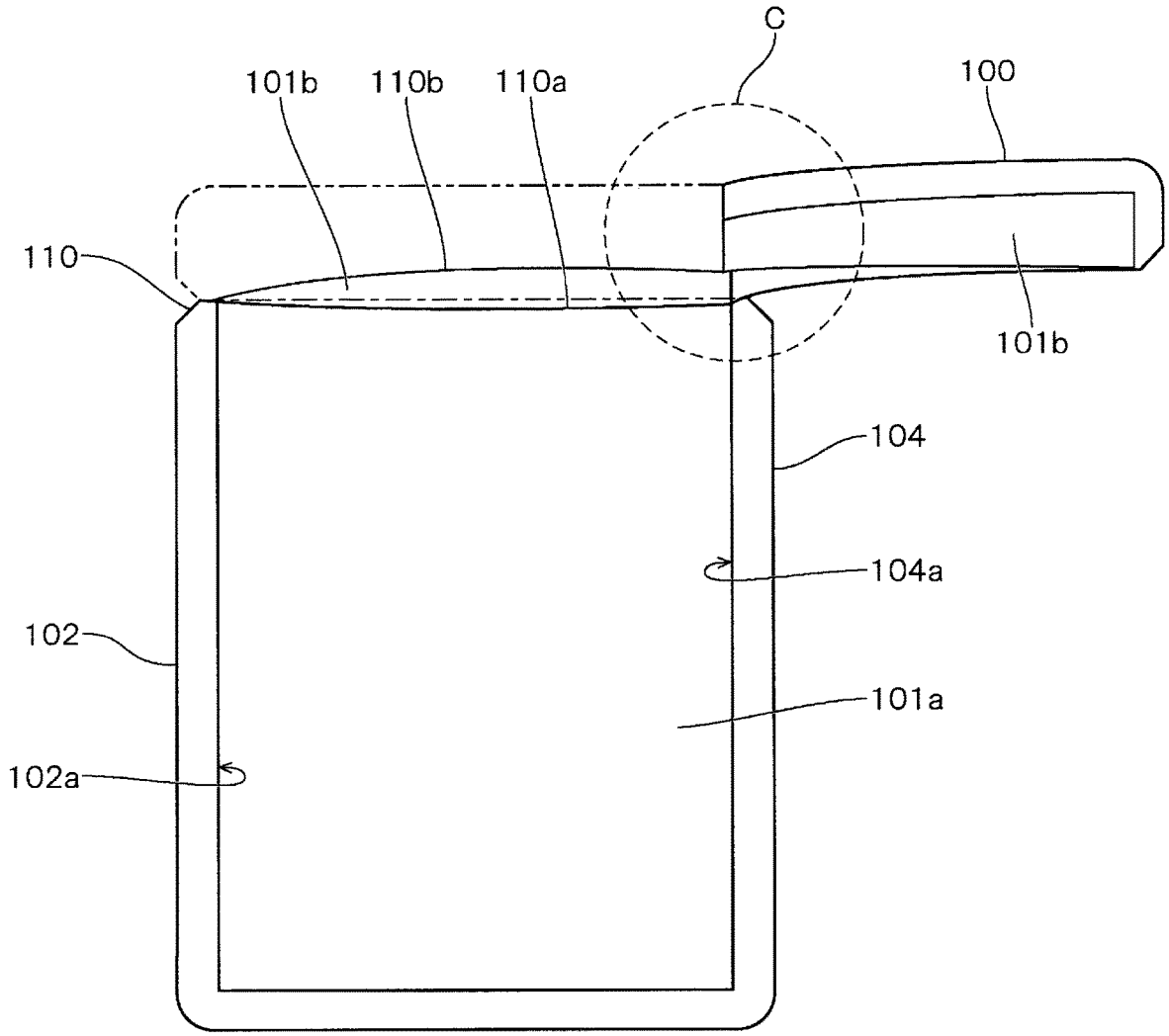
FIG. 28 shows a plan view showing a state of unsealing a conventional packaging bag.
Figure 29:
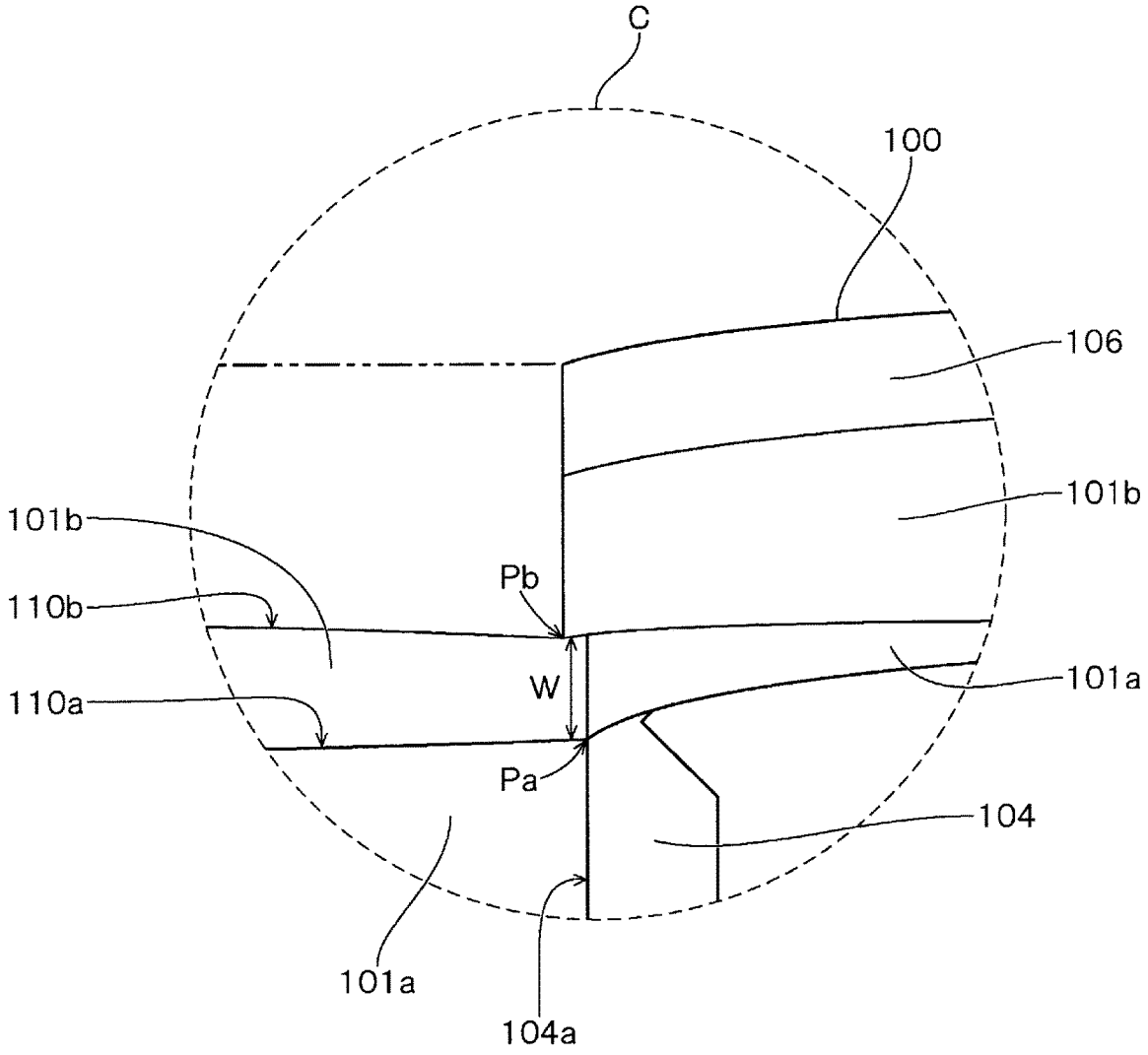
FIG. 29 shows an enlarged view of a part surrounded by a dashed line C in FIG. 28.

With reference to FIG. 26, the packaging bag according to the twelfth embodiment will be explained.

The unsealing guide line in the present embodiment is composed of the first unsealing guide line 56 provided on each of the front film 1*a* the back film 1*b* and the second unsealing guide line 54 branched from the first unsealing guide line 56. The first unsealing guide line 56 and the second unsealing guide line 54 are arranged such that they are inclined oppositely relative to the unsealing virtual straight line 12 and is remote from each other as they approach the left side sealed part 2.

The start end 56*a* of the first unsealing guide line 56 is arranged below the unsealing virtual straight line 12 for a prescribed distance L or longer, and the start end 54*a* of the second unsealing guide line 54 is arranged above the unsealing virtual straight line 12 for a prescribed distance L or longer. As a result, it is possible to increase the possibility that the break line arrives at at least one of the first unsealing guide line 56 and the second unsealing guide line 54.

On the other hand, the terminal end 56*b* of the first unsealing guide line 56 is arranged on the inner edge 4*a* of the right side sealed part 4, and the terminal end 54*b* of the second unsealing guide line 54 is arranged on the point P on the first unsealing guide line 56. Therefore, when unsealing, the break line that arrives at the first unsealing guide line 56 is induced to the terminal end 56*b* on the inner edge 4*a* on the right side sealed part 4. On the other hand, the break line that arrives at the second unsealing guide line 54 is induced to the terminal end 54*b* (i.e. the point P on the first unsealing guide line 56) and, subsequently, is induced to the terminal end 56*b* on the inner edge 4*a* on the right side sealed part 4 by the first unsealing guide line 56. As mentioned above, also in the present embodiment, both the front and back break line are induced to a single point on the inner edge 4*a* of the right side sealed part 4. As a result, the right side sealed part 4 can be tom by a small shear strength, and one break line progresses from the corner on the right side sealed part 4 and a broken piece can be easily separated.

Hereinabove, the embodiment of the present invention is explained. The present invention is not restricted to the above-mentioned embodiment, and various modifications are possible within the scope of the present invention. In the above-mentioned embodiment, an explanation is made on an unsealing guide line that extends linearly. The unsealing guide line is not restricted to a straight line and may be linear or curved.

In the above-mentioned embodiment, an explanation is made on a packaging bag in the form of a flat pouch of which the four sides are heat-sealed. In the present invention, the shape of the packaging bag is not limited thereto. The present invention can be applied to a standing pouch, a pouch with a gazette and a packaging bag of which the three sides of the folded film are sealed.

As for the length and the width of each of the pair of the side sealed parts, they may be the same or different. The pair of the side sealed parts may be arranged symmetrically or unsymmetrically with respect to the central line of the packaging bag. The pair of side sealed parts may be arranged in parallel or in non-parallel with each other. For example, when the pair of side sealed parts are non-parallel with each other, and the flat shape of the packaging bag is trapezoidal, the central axis of this trapezoid is a symmetrical axis line that extends longitudinally.

INDUSTRIAL APPLICABILITY

The packaging bag according to the present invention can be applied to various packaging bags used for drinks or pharmaceuticals in addition to packaging bags that accommodate foods such as a retort pouch.

The documents described in the specification and the specification of Japanese application(s) on the basis of which the present application claims Paris convention priority are incorporated herein by reference in its entirety.

DESCRIPTION ON REFERENCE NUMERALS

1. Packaging bag
1*a*. Front film
1*b*. Back film
1*c*. Broken piece
2. Side sealed part
2*a*. Inner edge of the side sealed part
3. Accommodation part
4. Side sealed part
4*a*. Inner edge of side sealed part
5. Inclined sealed part
6. Top sealed part
6*a*. Lower edge of top sealed part
8. Bottom sealed part
10. Easily-openable part
10*a*. Break line of front film (front break line)
10*b*. Break line of back film (back break line)
10*c*. Break line of right side sealed part
11. Symmetrical axis line
12. Unsealing virtual straight line
14, 16, 17, 18, 20, 22, 30, 32, 34, 38, 40, 42, 44, 46, 48, 54 and 56 Unsealing guide line
14*a*, 16*a*, 17*a*, 18*a*, 20*a*, 22*a*, 30*a*, 32*a*, 34*a*, 38*a*, 40*a*, 42*a*, 44*a*, 46*a*, 48*a*, 54*a* and 56*a* End (start end) of unsealing guide line
14*b*, 16*b*, 17*b*, 18*b*, 20*b*, 22*b*, 30*b*, 32*b*, 34*b*, 38*b*, 40*b*, 42*b*, 44*b*, 46*b*, 48*b*, 54*b* and 56*b* End (terminal end) of unsealing guide line
15. Reinforced part
15*a*. Edge of reinforced part
51. Extended part
70, 71 and 72 Inclined sealed part
73. Mountain-shaped sealed part
74. Curved sealed part
75, 76 and 77. Inversely inclined sealed part
78. Inversely mountain-shaped sealed part
79. Inversely curved sealed part

The invention claimed is:

1. A packaging bag comprising:

a sealed part provided around an end of a front film and a back film being superimposed on each other, the sealed part being unsealed from a sealed part on an unsealing start side of the package bag to a sealed part on an unsealing terminal side of the package bag across an accommodation part;

an easily-openable part being provided on the sealed part on the unsealing start side, and, in the accommodation part between the sealed part on the unsealing start side and the sealed part on the unsealing terminal side or in an inner edge of the sealed part on the unsealing terminal side, a front unsealing guide line provided on the front film and a back unsealing guide line provided on the back film are provided, the front unsealing guide line and the back unsealing guide line extending in an inclined manner with respect to an unsealing virtual straight line linearly drawn in an unsealing direction from the easily-openable part to the sealed part on the unsealing terminal side, wherein an end of the front unsealing guide line on the unsealing terminal side and an end of the back unsealing guide line on the unsealing terminal side are superimposed on each other on the inner edge or in the vicinity of the inner edge of the sealed part on the unsealing terminal side or on a lower edge or in the vicinity of the lower edge of the sealed part on the unsealing start side, wherein, when the packaging bag is unsealed, a break line of the front film and/or a break line of the back film are guided by the front unsealing guide line and/or the back unsealing guide line so that the break line of the front film and the break line of the back film are joined in a superimposed manner to arrive at the same point on the unsealing terminal side, wherein the front unsealing guide line and the back unsealing guide line are formed as an inner edge inclined part that is an inner edge of the sealed part on the unsealing terminal side, wherein the inner edge inclined part is inclined at an inclination angle of 60 degrees or less relative to the unsealing virtual straight line, and wherein a virtual opening width that is a gap between an inner edge of the sealed part on the unsealing start side and an inner edge of the sealed part on the unsealing terminal side on the unsealing virtual straight line is 35 mm or more.

2. The packaging bag according to claim 1, wherein the inner edge inclined part is inclined at least in a misalignment range of the break lines of the front film and the back film.

3. The packaging bag according to claim 1, wherein a gap H from the unsealing virtual straight line to a lower end of the inner edge inclined part on a bottom side is 5/18 or less relative to the maximum width D between the sealed part on the unsealing start side and the sealed part on the unsealing terminal side.

4. The packaging bag according to claim 1, wherein the inner edge inclined part is linearly inclined.

5. The packaging bag according to claim 1, wherein the inner edge inclined part is curved, and a tangent line of the curve is inclined relative to the unsealing virtual straight line.

6. The packaging bag according to claim 1, wherein an end on the unsealing start side of each of the front unsealing guide line and the back unsealing guide line is positioned closer to a bottom side than the unsealing virtual straight line, and an end on the unsealing terminal side of the unsealing guide line is positioned on the unsealing virtual straight line or closer to the opening side than the unsealing virtual straight line.

7. The packaging bag according to claim 1, wherein an end on the unsealing terminal side of each of the front unsealing guide line and the back unsealing guide line is superimposed on each other on the inner edge or in the vicinity of the inner edge of the sealed part on the unsealing terminal side, an end of each of the front unsealing guide line and the back unsealing guide line is positioned closer to the opening side than the unsealing virtual straight line, and an end on the unsealing terminal side of each of the front unsealing guide line and the back unsealing guide line is positioned on the unsealing virtual straight line or is closer to the bottom side than the unsealing virtual straight line.

8. The packaging bag according to claim 7, wherein an end on the unsealing start side of each of the front unsealing guide line and the back unsealing guide line is positioned on the lower edge of the sealed part closer to the opening side.

9. The packaging bag according to claim 6, wherein an end on the unsealing terminal side of each of the front unsealing guide line and the back unsealing guide line is positioned such that the end is remote from the unsealing virtual straight line for a distance of 28% or more of the length along the unsealing virtual straight line between an inner edge of the sealed part on the unsealing start side and an inner edge of the sealed part on the unsealing terminal side.

10. The packaging bag according to claim 6, wherein an end on the unsealing terminal side of each of the front unsealing guide line and the back unsealing guide line is positioned such that the end is remote from the unsealing virtual straight line for a distance of 38% or more of the length along the unsealing virtual straight line between an inner edge of the sealed part on the unsealing start side and an inner edge on the sealed part on the unsealing terminal side.

11. The packaging bag according to claim 7, wherein an end on the unsealing terminal side of each of the front unsealing guide line and the back unsealing guide line is positioned closer to the bottom side of the unsealing virtual straight line and is remote from the unsealing straight line for a distance of within 23% of the length along the unsealing virtual straight line between an inner edge of the sealed part on the unsealing start side and an inner edge of the sealed part on the unsealing terminal side.

12. The packaging bag according to claim 6, wherein an end on the unsealing start side of each of the front unsealing guide line and the back unsealing guide line is positioned on the inner edge of the sealed part on the unsealing start end side.

13. The packaging bag according to claim 6, wherein an end on the unsealing start side of each of the front unsealing guide line and the back unsealing guide line is positioned such that it is remote from the unsealing virtual straight line for a distance of 28% or more of the length along the unsealing virtual straight line between an inner edge of the sealed part on the unsealing start side and an inner edge of the sealed part on the unsealing terminal side.

14. The packaging bag according to claim 6, wherein an end on the unsealing start side of each of the front unsealing guide line and the back unsealing guide line is positioned such that it is remote from the unsealing virtual line for a distance of 38% or more of the length along the unsealing virtual straight line between an inner edge of the sealed part on the unsealing start side and an inner edge of the sealed part on the unsealing terminal side.

15. The packaging bag according to claim 6, wherein the inclination angle of the unsealing guide line relative to the unsealing guide line is 10° to 50°.

16. The packaging bag according to claim 6, wherein the front unsealing guide line and the back unsealing guide line are formed of an edge of a reinforced part that is hardly broken as compared with the front film and the back film.

17. The packaging bag according to claim 6, wherein the front unsealing guide line and the back unsealing guide line are formed of a weakened part that is easily broken as compared with the front film and the back film.

* * * * *